US006210242B1

(12) United States Patent
Howard et al.

(10) Patent No.: US 6,210,242 B1
(45) Date of Patent: Apr. 3, 2001

(54) PEDAL-POWERED WATERCRAFT

(76) Inventors: Harry Howard, 1926 S. Glenstone, #214, Springfield, MO (US) 65804; Tara Ann Howard, 8805 Ampezo Trail, Austin, TX (US) 78745

( * ) Notice: Subject to any disclaimer, the term of this patent is extended or adjusted under 35 U.S.C. 154(b) by 0 days.

(21) Appl. No.: 09/416,917

(22) Filed: Oct. 13, 1999

(51) Int. Cl.[7] ..... B63H 16/00

(52) U.S. Cl. ..... 440/21; 440/12.62; 440/26; 440/27; 440/29; 440/30; 114/62

(58) Field of Search ..... 440/12.62, 21, 440/26, 27, 29, 30, 31; 114/62; D12/306

(56) References Cited

U.S. PATENT DOCUMENTS

| | | | | |
|---|---|---|---|---|
| D. 159,204 | * | 7/1950 | Heels et al. | D12/306 |
| D. 193,041 | * | 6/1962 | Leger | D12/306 |
| D. 295,510 | | 5/1988 | Carter . | |
| D. 326,442 | * | 5/1992 | Shutt | D12/306 |
| D. 326,840 | | 6/1992 | Bullock . | |
| D. 338,868 | | 8/1993 | Ackerbloom . | |
| D. 375,930 | * | 11/1996 | Howard | D12/306 |
| D. 399,814 | * | 10/1998 | Toro et al. | D12/306 |
| 538,353 | | 4/1895 | Schermerhorn . | |
| 911,806 | | 2/1909 | Broward . | |
| 1,072,027 | | 9/1913 | Mosteller . | |
| 1,651,785 | | 12/1927 | Ulrich . | |
| 1,761,883 | | 6/1930 | Froedtert . | |
| 2,283,291 | | 5/1942 | Selden . | |
| 2,328,041 | | 8/1943 | Wellons . | |
| 2,555,886 | | 6/1951 | Jones . | |
| 2,735,392 | | 2/1956 | Cox . | |
| 2,803,837 | | 8/1957 | Virobik . | |
| 2,875,720 | | 3/1959 | Hupp . | |
| 2,919,669 | | 1/1960 | Kikuhara . | |
| 2,931,332 | | 4/1960 | Hebrank . | |
| 2,945,466 | | 7/1960 | Shelton . | |
| 2,989,939 | | 6/1961 | Tatter . | |

(List continued on next page.)

OTHER PUBLICATIONS

"Dimpled Bottoms?," *Professional Boat Builder*, No. 7, Feb./Mar. 1999, pp. 17–18.

"Stability and Other Factors in the Design of Displacement Boats," *Human Power*, vol. 13 No. 3, summer/fall 1988, pp. 3–5.

"Lower–extremity Power Output in Recumbent Cycling: A Literature Review," *Human Power*, vol. 13 No. 3, summer/fall 1988, pp. 6–12.

"My HPV . . . is an HPB," *HPV News*, Jul./Aug. 1998, pp. 10–12.

*Primary Examiner*—S. Joseph Morano
*Assistant Examiner*—Ajay Vasudeva
(74) *Attorney, Agent, or Firm*—Alvin R. Wirthlin; Akin, Gump, Strauss, Hauer & Feld, L.L.P.

(57) ABSTRACT

A pedal-powered watercraft comprises a unitary hull having an upper wall extending from a bow portion to a stern portion of the watercraft and a pair of spaced hollow sponsons located on either side of the upper wall. The upper wall together with inner walls of the sponsons form a tunnel that opens generally downwardly and extends from the bow portion to the stern portion of the watercraft. A deck is connected to the hull and includes an elongate opening that defines a cockpit area for receiving an occupant. A seat is located in the cockpit area and a pedal assembly is connected to the hull forwardly of the seat. The pedal assembly includes a pivotal pedal tower and a pair of pedals rotatably mounted on the pedal tower. The pair of pedals are operably connected to drive the propeller during pedal rotation.

41 Claims, 17 Drawing Sheets

U.S. PATENT DOCUMENTS

| | | | | |
|---|---|---|---|---|
| 2,990,805 | | 7/1961 | Jacus . | |
| 3,010,421 | | 11/1961 | Perkins . | |
| 3,257,987 | | 6/1966 | Liard . | |
| 3,295,487 | | 1/1967 | Smith . | |
| 3,440,995 | | 4/1969 | Welsh . | |
| 3,469,549 | * | 9/1969 | Rae | 114/288 |
| 3,497,887 | | 3/1970 | Bureau, Jr. . | |
| 3,602,179 | | 8/1971 | Cole . | |
| 3,763,813 | | 10/1973 | Holtz . | |
| 3,910,214 | | 10/1975 | Holter . | |
| 3,911,845 | | 10/1975 | Holtom . | |
| 3,999,501 | | 12/1976 | Duarte . | |
| 4,170,188 | * | 10/1979 | Jamison, Jr. | 440/30 |
| 4,193,366 | | 3/1980 | Salminen . | |
| 4,221,275 | * | 9/1980 | Pennebaker et al. | 180/206 |
| 4,318,700 | | 3/1982 | Price . | |
| 4,349,340 | | 9/1982 | Hoffmann . | |
| 4,427,392 | * | 1/1984 | Schneider | 440/30 |
| 4,432,298 | | 2/1984 | Cudmore . | |
| 4,459,116 | | 7/1984 | Moore . | |
| 4,493,658 | * | 1/1985 | Hildebrand | 440/30 |
| 4,526,392 | | 7/1985 | Berkstresser . | |
| 4,533,330 | | 8/1985 | Chun . | |
| 4,572,535 | | 2/1986 | Stewart et al. . | |
| 4,584,957 | | 4/1986 | Belvedere . | |
| 4,635,577 | | 1/1987 | Palmquist . | |
| 4,698,034 | * | 10/1987 | Anthonijsz | 440/27 |
| 4,746,312 | | 5/1988 | Matos Teodosio et al. . | |
| 4,795,381 | | 1/1989 | Willems . | |
| 4,867,718 | | 9/1989 | duPont . | |
| 4,891,024 | | 1/1990 | Benjamin . | |
| 4,943,251 | | 7/1990 | Lerach et al. . | |
| 4,968,274 | | 11/1990 | Gregory . | |
| 5,011,441 | | 4/1991 | Foley et al. . | |
| 5,042,416 | | 8/1991 | Arcouette . | |
| 5,163,857 | | 11/1992 | Hinsley . | |
| 5,194,023 | | 3/1993 | Stone . | |
| 5,194,024 | | 3/1993 | Shiraki . | |
| 5,217,398 | | 6/1993 | Meron et al. . | |
| 5,224,886 | * | 7/1993 | Cunningham | 440/12 |
| 5,362,264 | * | 11/1994 | Parant | 440/29 |
| 5,387,140 | * | 2/1995 | Cunningham | 440/12 |
| 5,427,554 | | 6/1995 | Foglia . | |
| 5,460,551 | | 10/1995 | Beres . | |
| 5,471,942 | | 12/1995 | Miller et al. . | |
| 5,651,706 | * | 7/1997 | Kasper | 440/29 |
| 5,655,473 | * | 8/1997 | Arvilla | 114/61 |
| 5,785,564 | | 7/1998 | Von Ohain et al. . | |
| 5,860,378 | | 1/1999 | Schaller . | |
| 5,937,964 | * | 8/1999 | Mayer et al. | 180/220 |
| 6,077,134 | * | 6/2000 | Lam | 440/12.62 |

* cited by examiner

PEDAL-POWERED WATERCRAFT

CROSS-REFERENCE TO RELATED PATENTS

This application is related to U.S. Pat. No. Des. 399,814, issued on Oct. 20, 1998.

BACKGROUND OF THE INVENTION

1. Field of the Invention

This invention relates to watercraft, and more particularly to occupant-powered watercraft.

2. Description of the Related Art

The popularity of pedal-type watercraft has increased in recent years, due at least in part to individuals who are both health-conscious and concerned for their personal safety on the roadways. Bicycling, although quite popular, is high on the list of most dangerous activities. With increased congestion on roadways and its accompanying hazards, many cyclists have turned to the waterways where the workout of a bike ride is combined with wide open spaces and its accompanying scenery. Moreover, recent laws banning motorized personal watercraft due to environmental concerns have also contributed to the increasing popularity of pedal-powered watercraft.

One type of pedal-powered watercraft is disclosed in U.S. Pat. No. 4,795,381 issued to Willems on Jan. 3, 1989. The watercraft in this patent includes a floating body upon which a pedal assembly and recumbent seat are mounted. The seat can be adjusted toward or away from the pedal assembly to accommodate different sizes of users. An endless drive chain, reduction gearing, and a drive shaft connect the pedal assembly to a propeller. In one embodiment of this patent, the propeller and drive shaft extend downwardly and rearwardly from the floating body. A tandem seating arrangement is also shown.

Another type of pedal-powered watercraft is disclosed in U.S. Pat. No. 5,460,551 issued to Beres on Oct. 24, 1995. In this patent, the pedal-powered watercraft is shaped as a kayak with an integrally molded seat. A pedal assembly is connected to a propeller through a transmission and drive shaft arrangement. A front storage compartment as well as a rear storage compartment are provided.

Pedal-powered watercraft similar to the above types have hulls that are inherently unstable in the water. Great skill is required to keep the vessel from capsizing, especially during mounting, dismounting, pedaling, and turning operations. Many potential users, especially those that pursue recreation only occasionally or those that lack confidence in the water, may thus be apprehensive about using such watercraft.

Prior art pedal-powered watercraft also suffer in their inefficiency to translate rotational motion of the pedals into watercraft speed. Many users find that their legs become tired before completing the time interval needed for an ideal cardiovascular workout, while the distance traveled is somewhat less than exhilarating. Increasing the rotational speed of the pedals often does little toward increasing the speed of watercraft movement. As an example, typical pedal-powered watercraft having a pair of side-by-side pedal assemblies only travels approximately 1–2 mph in the water, despite increased rotational speed of the pedals.

SUMMARY OF THE INVENTION

It is therefore an object of the present invention to provide a pedal-powered watercraft that overcomes the problems associated with the prior art.

It is a further object of the invention to provide a pedal-powered watercraft that is relatively stable in the water.

It is an even further object of the invention to provide a pedal-powered watercraft that has improved efficiency of occupant effort to watercraft velocity.

According to the invention, an occupant-powered watercraft comprises a unitary hull having an upper wall extending from a bow portion to a stern portion of the watercraft with a pair of spaced hollow sponsons located on either side of the upper wall. Each sponson extends along the length of the hull and has an inner wall connected to an outer wall by a bottom wall and front and rear walls to thereby form a hollow interior. The inner walls of the sponsons are integrally joined to opposite sides of the upper wall. The upper wall together with the inner walls of the sponsons form a tunnel that opens generally downwardly and extends from the bow portion to the stern portion of the watercraft. A deck is connected to the hull and includes elongate opening that defines a cockpit area for receiving an occupant. A seat is located in the cockpit area and a pedal assembly is connected to the hull forwardly of the seat. The pedal assembly includes a pair of rotatable pedals. A propeller is operably connected to the pair of pedals for rotation of the propeller in response to rotation of the pedals. With this arrangement, forward movement of the watercraft from rotation of the propeller causes water to enter into the tunnel at the bow portion and exit the tunnel at the stern portion.

Other objects and advantages of the invention will become apparent upon reading the following detailed description and appended claims, and upon reference to the accompanying drawings.

BRIEF DESCRIPTION OF THE DRAWINGS

The preferred embodiments of the present invention will hereinafter be described in conjunction with the appended drawings, wherein like designations denote like elements, and wherein.

It is noted that the drawings of the invention are not necessarily to scale. The drawings are merely schematic representations, not intended to portray specific parameters of the invention. The drawings are intended to depict only typical embodiments of the invention, and therefore should not be considered as limiting the scope of the invention. The invention will now be described with additional specificity and detail through the accompanying drawings.

DETAILED DESCRIPTION OF THE PREFERRED EMBODIMENTS

Figure 1:
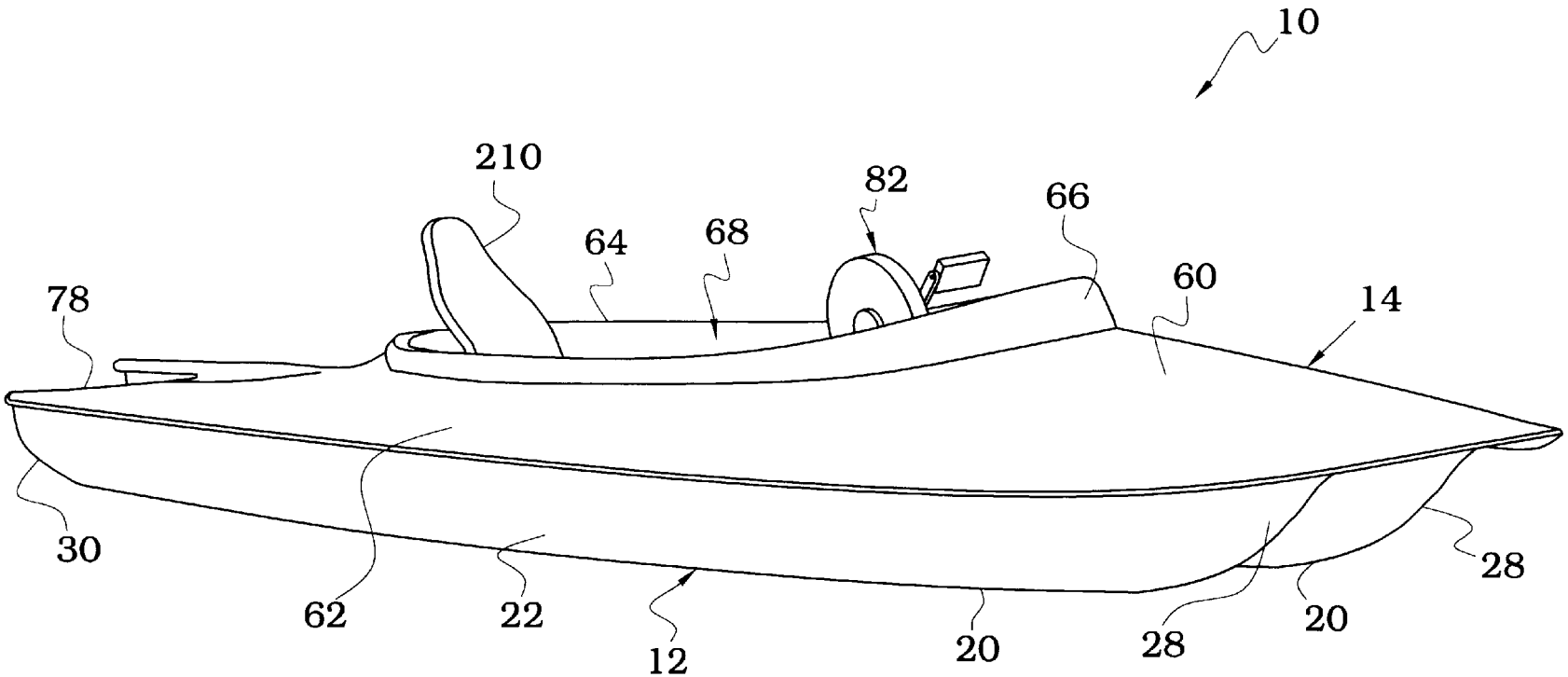
FIG. 1 is a perspective view of a pedal-powered watercraft according to the invention.
Figure 2:
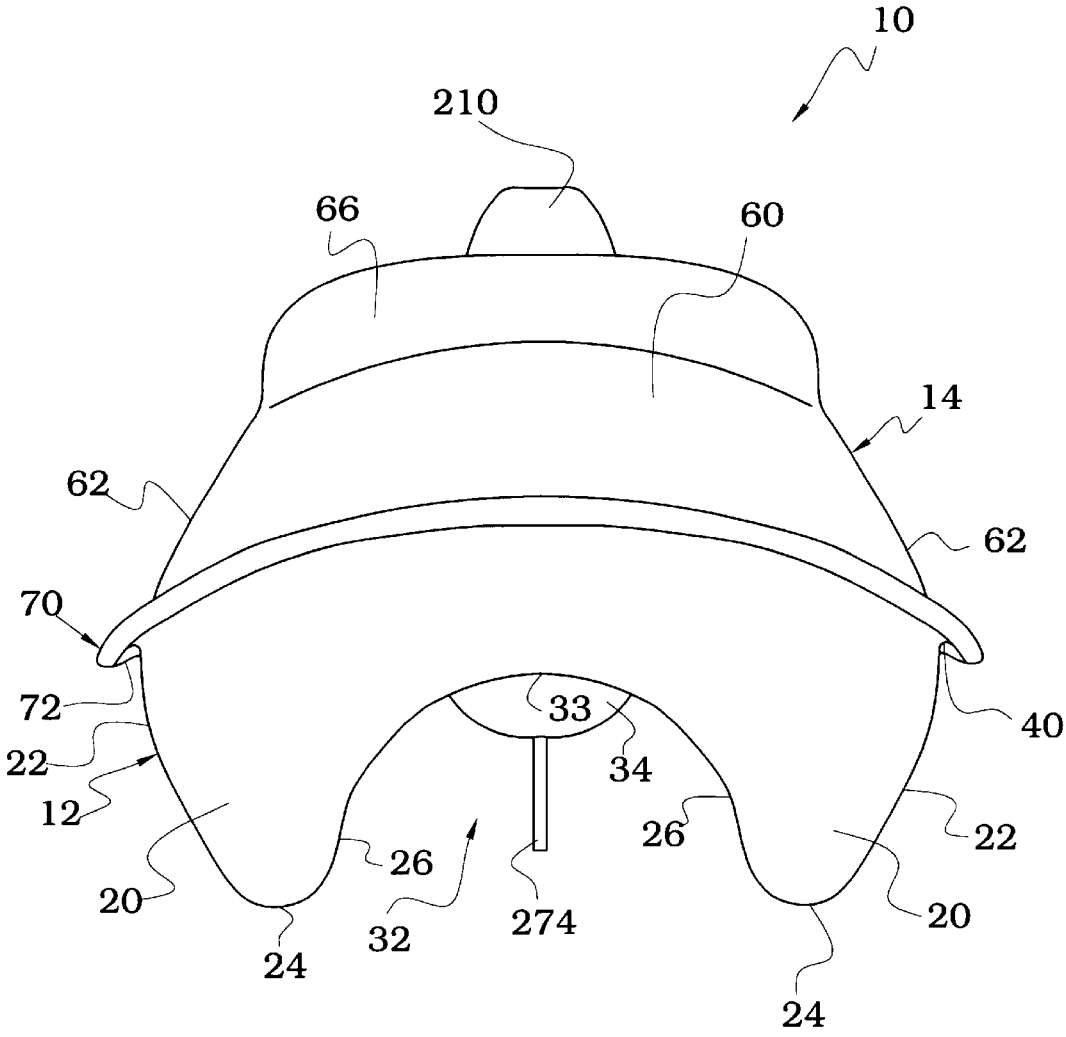
FIG. 2 is a front elevational view of the pedal-powered watercraft of FIG. 1.
Figure 3:
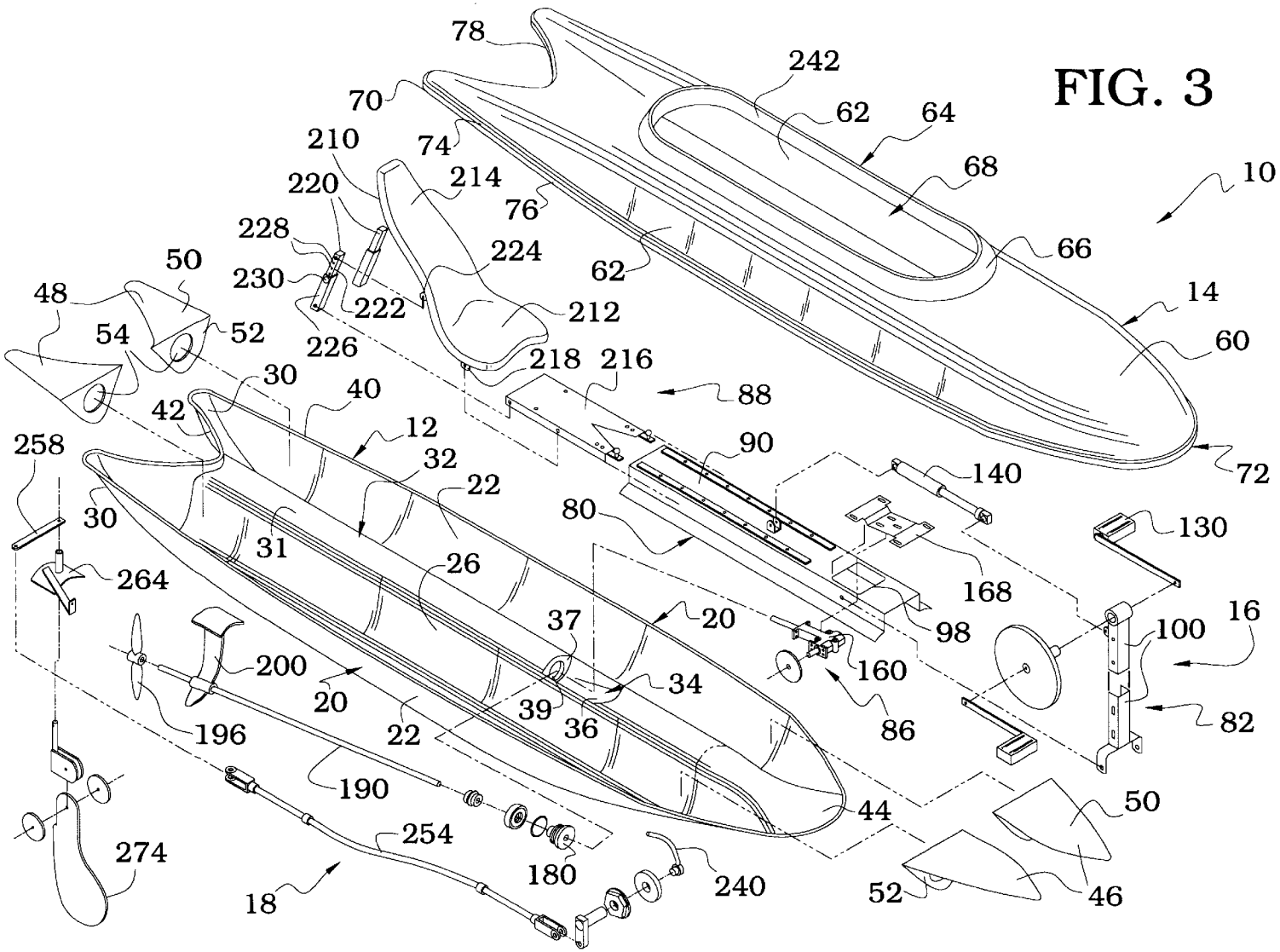
FIG. 3 is an exploded isometric view of the pedal-powered watercraft of FIG. 1.

Referring now to the drawings, and to FIGS. 1 to 3 in particular, a pedal-powered watercraft 10 according to the invention is illustrated. The watercraft 10 includes a hull 12, a deck 14, a locomotive assembly 16, and a steering assembly 18, all preferably connected to the hull 12.

The hull 12 is preferably formed as a unitary structure and includes a pair of hollow sponsons 20 that extend the length of the hull. Each sponson 20 includes an outer wall 22 and inner wall 26 that curve generally outwardly with respect to a longitudinal centerline of the hull, a bottom wall 24 that extends between the inner and outer walls and curves generally downwardly, a front wall 28 that extends upwardly from a forward portion of the bottom wall and between the inner and outer walls, and a rear wall 30 that extends upwardly from a rearward portion of the bottom wall and between the inner and outer walls.

The inner walls 26 of the sponsons 20 converge with an upper wall 31 that together form a tunnel 32 that extends the length of the hull. The upper wall 31 of the tunnel 32 includes an upper surface 33 and a lower surface 35 (see FIG. 7). In this embodiment, the tunnel 32 is preferably semi-cylindrical and substantially uniform in shape throughout its length, with the exception of a protrusion 34 that extends downwardly into the tunnel 32 to accommodate a transmission assembly 86 that forms part of the locomotion assembly 16. The protrusion 34 includes a lower wall 36 that slopes generally downwardly and rearwardly toward the stern of the hull 12, and an upright wall 37 that extends generally upwardly from the lower wall 36. An opening 39 is formed in the wall 37 for a purpose to be described in greater detail below with respect to FIG. 6. The particular advantages of the tunnel 32 will be described in further detail below in conjunction with the locomotion assembly 16.

The front wall 28 of each sponson 20 curves generally downwardly and forwardly to reduce drag and provide lift to the bow during forward movement of the watercraft 10 through water. The rear wall 30 of each sponson curves generally downwardly and rearwardly to advantageously provide greater maneuverability in the water during turning than would otherwise be possible without the curve. This is due at least in part to the reduction of surface area in contact with the water during turning, and thus the reduction of forces inhibiting turning.

As shown most clearly in FIG. 3, a ledge 40 is formed around the top periphery of the hull 12. A curved section 42 separates rearwardly extending portions of the sponsons 20 at the stern of the watercraft 10, while a web section 44 joins the sponsons at the bow. The web section 44 helps to shield an operator from overspray or splashing, especially during travel in rough water.

Figure 5:
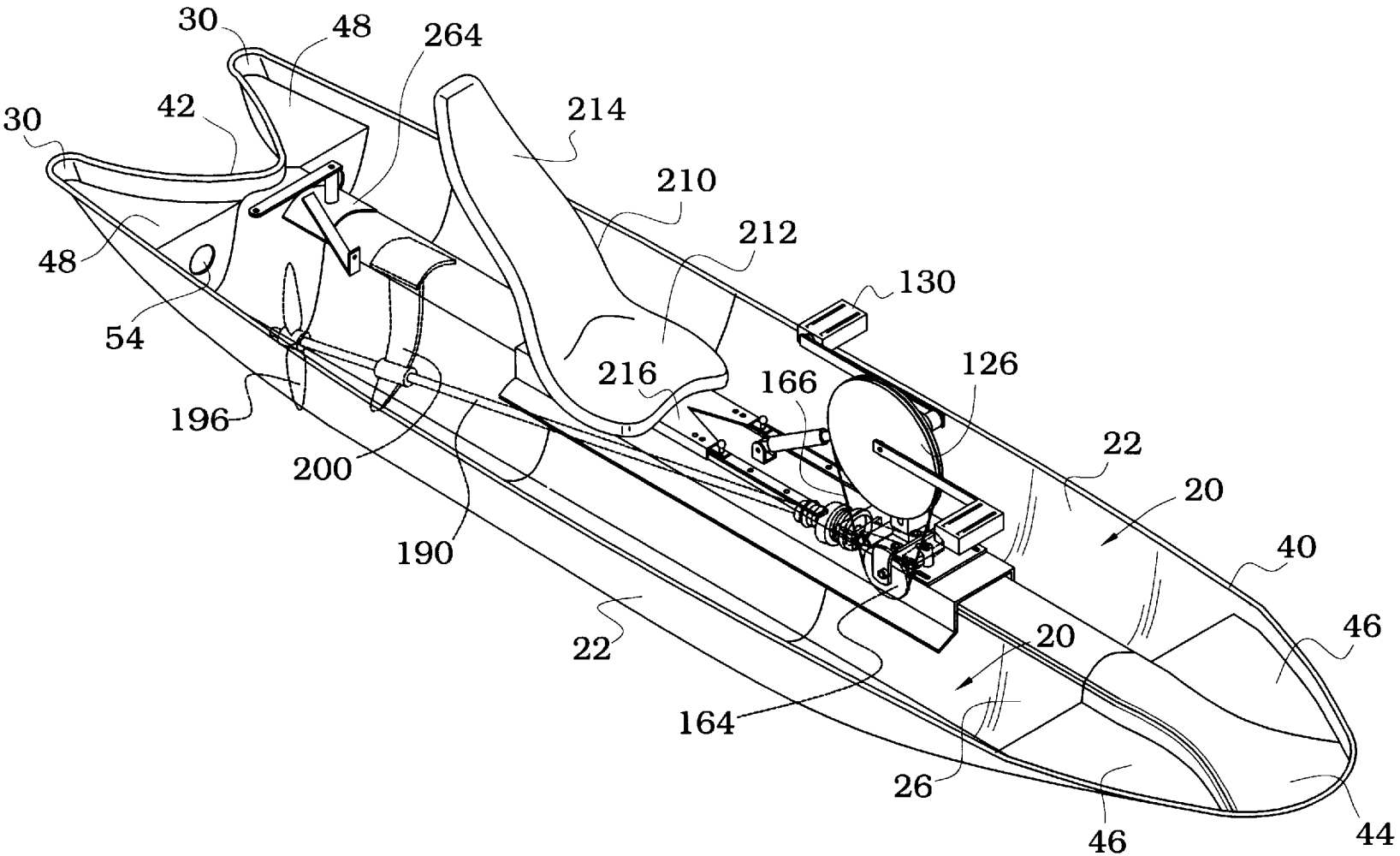
FIG. 5 is an isometric view of the watercraft hull with the seat, pedal and transmission assemblies well as a portion of the steering assembly attached to the hull.

With additional reference to FIG. 5, a pair of front inserts 46 are mounted in the bow of the hull 12 while a pair of rear inserts 48 are mounted in the stern. Each insert 46, 48 includes a generally horizontally extending wall 50 and a generally vertically extending wall 52 that depends from the wall 50. The edges of each insert 46, 48 are shaped to fit snugly against the inner wall 26, the outer wall 22, the bottom wall 24, and the front or rear wall 28 or 30 of its respective sponson to thereby form four air-tight compartments. Preferably, an opening 54 is formed in each wall 52 in order to permit access into the compartments for storing equipment and supplies. The openings are preferably sealed by a removable cap (not shown) in order to maintain the air-tight integrity of the compartments.

Referring again to FIGS. 1 to 3, the deck 14 is preferably of single piece construction and includes an upper wall 60 that curves generally downwardly toward the bow and stern portions of the deck from a cowling 66. A pair of side walls 62 also extend generally downwardly toward the port and starboard sides of the deck from the upper wall. An oblong opening 64 is formed in the deck 14. The cowling 66 is formed integrally with the upper wall 60 and side walls 62 and surrounds the opening 64. The opening 64 in the deck 14 provides access to a hollow interior space or cockpit 68 located between the hull 12 and deck 14. An inwardly curved section 78 at the stern portion of the deck matches the curved section 42 at the stern portion of the hull 12. A lower peripheral edge 70 of the deck 14 terminates in an L-shaped flange 72. The flange 72 has a first leg 74 that extends generally horizontally and a second leg 76 that extends downwardly from the first leg 74. When the deck is assembled to the hull, the first leg 74 of the deck and the ledge 40 are superimposed, and the second leg 76 extends downwardly past the ledge 40. With this arrangement, the fingers of a user can securely grip the ledge 40 and second leg 76 during handling, e.g. during lifting and carrying, of the watercraft 10.

The hull and deck are preferably constructed of a strong, light-weight and waterproof material, such as fiberglass, aluminum, composites, laminates, and the like. A multi-layer laminate known as Royalex™ is especially suitable for the hull and deck. This type of laminate comprises one or more core layers of foam material sandwiched between layers of ABS plastic which are in turn sandwiched between layers of vinyl. The foam layers contribute to increased buoyancy, the ABS layers add strength, durability and rigidity, and the vinyl layers provide a wear-resistant and waterproof barrier to the inner layers, as well as an aesthetically pleasing finish. Preferably, the hull 12 and deck 14 are joined at the ledge 40 and horizontal leg 74 through a suitable adhesive for the particular material selected. Alternatively, the hull and deck may be joined through ultrasonic welding, mechanical fastening, or other well-known joining means.

Figure 4:
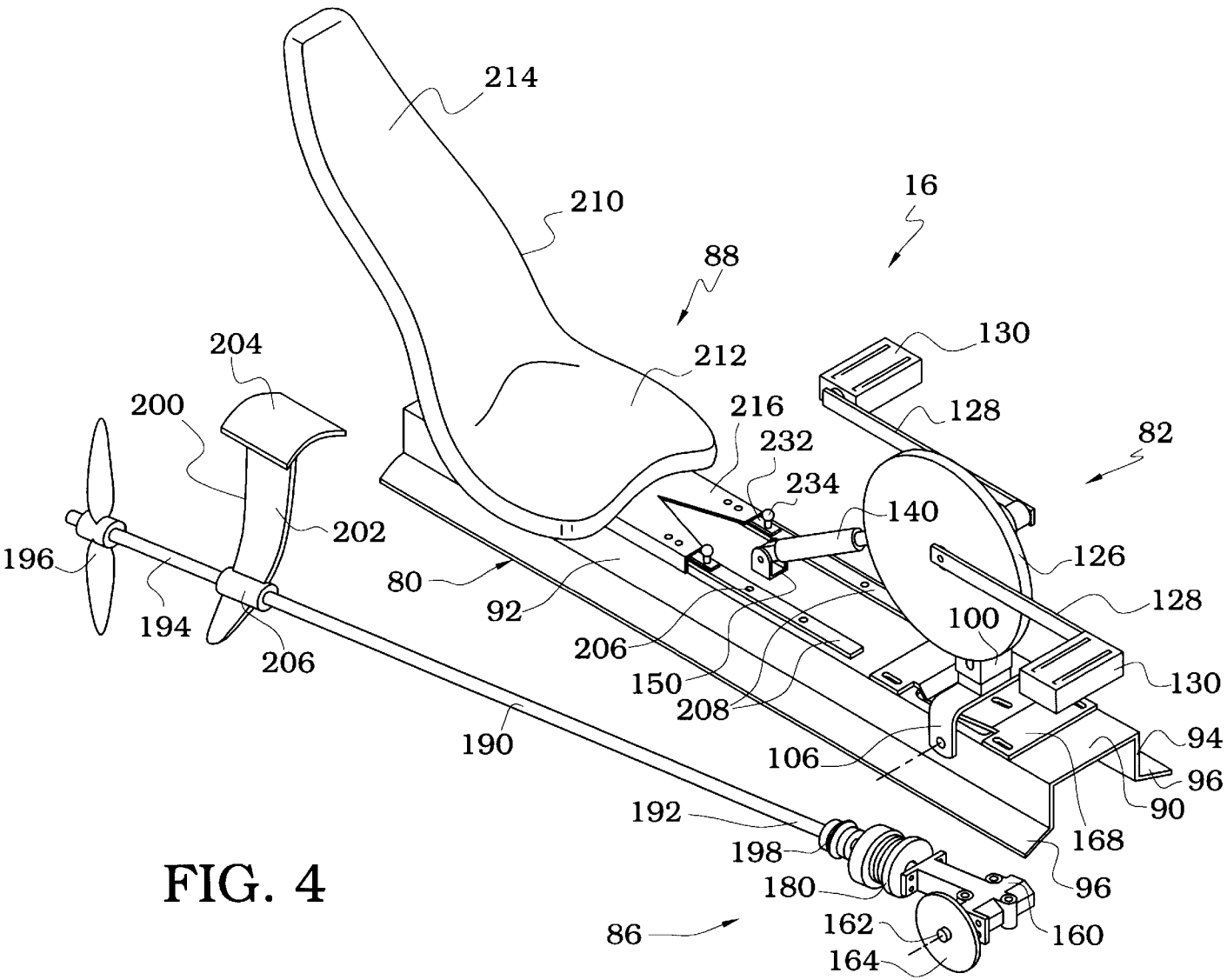
FIG. 4 is an an enlarged view of the seat, pedal and transmission assemblies of the pedal-powered powered watercraft in a substantially assembled form.

Turning now to FIGS. 3 to 5, the locomotion assembly 16 comprises a base frame 80 mounted to the hull 12, a pedal assembly 82 connected to the base frame, a transmission assembly 86 connected to the base frame proximal the pedal assembly, and an adjustable seat assembly 88 connected to the base frame rearwardly of the pedal assembly 82.

Figure 3A:
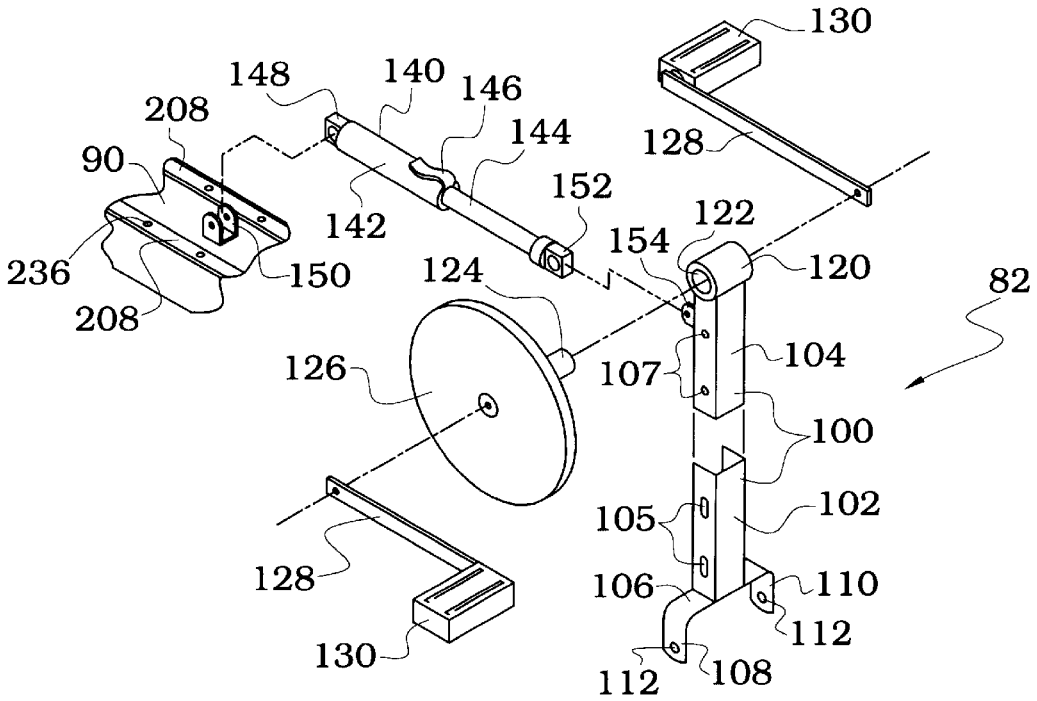
FIG. 3A is an enlarged exploded isometric view of the pedal assembly of FIG. 3.
Figure 3B:
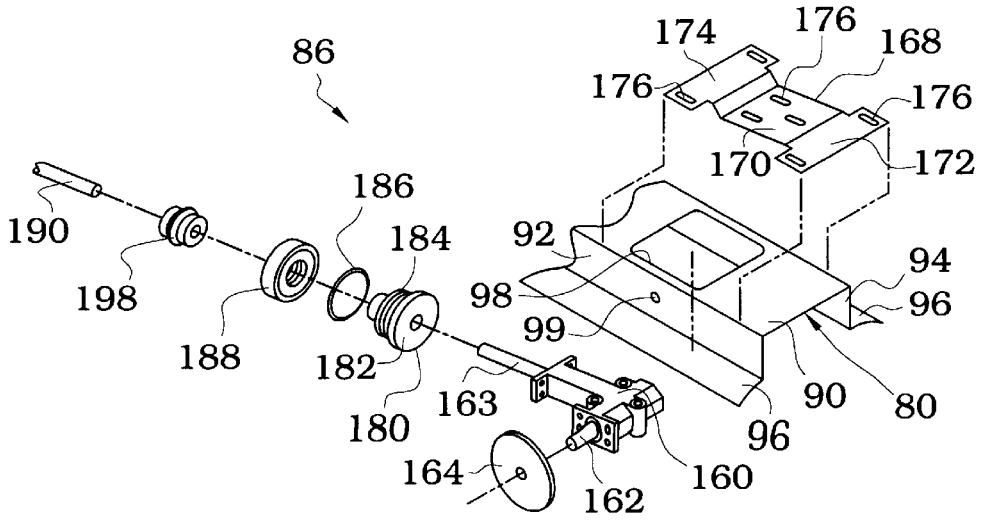
FIG. 3B is an enlarged exploded isometric view of the transmission assembly of FIG. 3.

As best shown in FIGS. 3B and 4, the base frame 80 is generally C-shaped in cross section and is preferably constructed of a lightweight and relatively rigid material, such as aluminum. The base frame 80 includes an upper platform 90 from which a pair of legs 92 and 94 depend. A flange 96 is formed at the lower free end of each leg 92, 94 and is shaped to contact an upper surface of the walls 26 that form the tunnel 34. The base frame 80 is mounted to the hull 12 by bonding the flanges 96 to the upper surface of the walls 26 with a suitable adhesive. Alternatively, the base frame 80 may be mounted to the hull through mechanical fasteners or a combination of adhesive and fasteners. An opening 98 (FIG. 3B) is formed in the platform 90 at a forward portion thereof and an aperture 99 is formed in each leg 92, 94 below the opening 98.

As best shown in FIG. 3A, the pedal assembly 82 includes a pedal tower 100 having a lower tower section 102 fixedly connected to an upper tower section 104 through suitable fasteners (not shown) that extend through elongate openings 105 in the lower section 102 and aligned apertures 107 in the upper section 104. The lower section 102 includes an inverse U-shaped mounting bracket 106 having a pair of spaced legs 108, 110 that straddle the base frame 80 such that the legs 108 and 110 are adjacent the legs 92 and 94, respectively. Each of the legs 108, 110 includes an aperture 112 that is in alignment with the apertures 99 of the base frame 80. A fastener (not shown) extends through each of the pairs of aligned apertures 112, 99 and pivotally connects the pedal tower 100 to the base frame 80.

The upper tower section 104 includes a bearing block 120 with a central bore 122 that rotatably receives an axle 124. The axle 124 is fixedly connected to an upper sprocket wheel 126. A pair of pedal arms 128 are in turn fixedly connected to the axle 124, and a foot pedal 130 is rotatably connected to a free end of each pedal arm 128 in a well-known manner.

A strut 140 is pivotally connected between the pedal tower 100 and the base frame 80 for selectively adjusting the pedals 130 with respect to the seat assembly 88. The strut 140 includes a tubular member 142 that telescopically receives a rod 144. A locking lever 146 is connected to the tubular member 142 for selectively fixing the position of the rod 144 with respect to the tubular member. Preferably, the tubular member 142 has an inner diameter that is slightly greater than the outer diameter of the rod 144 to allow free linear movement of the rod with respect to the tubular member when the locking lever is released. A gap (not shown) can be formed in the tubular member adjacent the exit point of the rod 144. Closure of the gap by the locking member causes the tubular member to press against and hold the rod 144 against movement. As an alternative to a locking lever, a spring-loaded push-button (not shown) may be mounted on the rod 144 and a series of apertures (not shown) may be formed in the tubular member 142 such that engagement of the push-button with one of the apertures prevents further telescopic movement of the rod with respect to the tubular member in a well-known manner. Other well-known means for fixedly adjusting the length of the strut 140 are also contemplated.

The outer end 148 of the tubular member 142 is pivotally mounted to a U-shaped bracket 150 located on the platform 90. Likewise, the outer end 152 of the rod 144 is pivotally mounted to a U-shaped bracket 154 located on the upper tower section 104. In this manner, the pedal tower 100 along with the pedals 130 can be tilted toward and away from the seat assembly 88 to thereby accommodate the size and personal preferences of a user.

As best shown in FIG. 3B, the transmission assembly 86 includes a transmission 160 having an input shaft 162 and an output shaft 163 that extends substantially perpendicular to the input shaft. The output shaft is connected to the input shaft through a bevel gear arrangement (not shown) within the transmission 160 such that for every revolution of the input shaft, the output shaft has a corresponding revolution. A lower sprocket wheel 164 is mounted on the input shaft 162 for rotation therewith and an endless drive chain 166 (FIG. 5) extends between the upper sprocket wheel 126 and the lower sprocket wheel 164. Preferably, the rotational axis of the input shaft 162 and the lower sprocket wheel 164 is coincident with the rotational axis of the pedal tower 100. In this manner, the chain 166 will remain taut when the pedal tower is pivoted. The upper sprocket wheel preferably has a greater number of teeth than the lower sprocket wheel. Preferably, the ratio between the upper sprocket wheel and the lower sprocket wheel is approximately 6:1 such that every revolution of the upper sprocket wheel causes six revolutions of the output shaft. Of course, other ratios can be chosen depending on varying factors such as the watercraft size, weight, user weight and strength, the desired cruising speed, and so on. When it is desirous to install, replace or tighten the chain 166, the fasteners (not shown) extending through the openings 105, 107 of the pedal tower are loosened and the upper tower section 104 is slid upwardly or downwardly with respect to the lower tower section 102 until the appropriate adjustments have been made and the chain is taut. The fasteners are then tightened.

Figure 6:
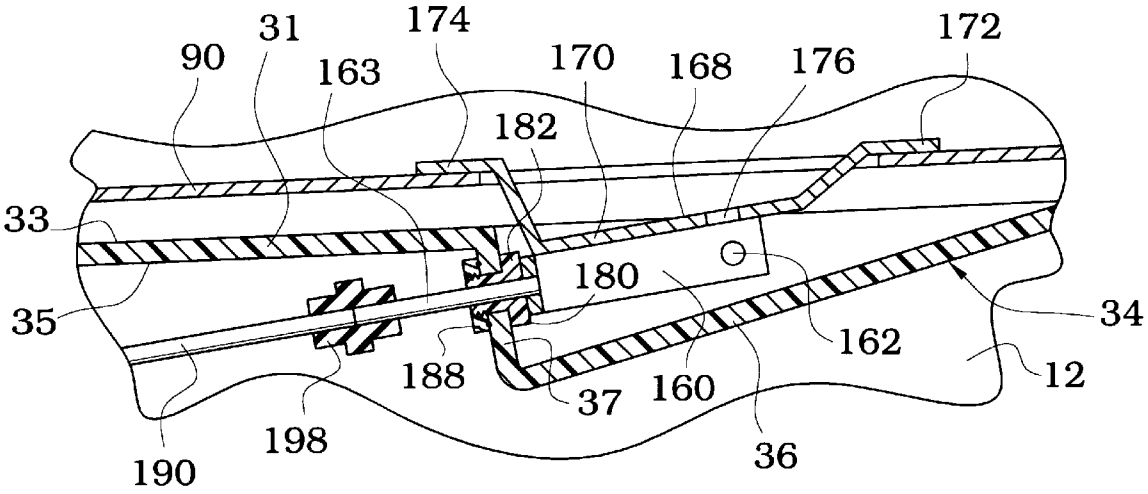
FIG. 6 is an enlarged cross sectional view of the hull and illustrating the connection between the hull and transmission mechanism.

With additional reference to FIG. 6, the transmission 160 is connected to the base frame 80 via a transmission mounting bracket 168. The mounting bracket 168 includes a transmission mounting plate 170 extending between a front flange 172 and a rear flange 174. The flanges 172, 174 lie flat against the upper surface of the platform 90 while the mounting plate 170 slopes generally downwardly and rearwardly from the front flange 172 toward the rear flange 174. A plurality of fasteners (not shown) extend through elongate apertures 176 formed in the plate 170 and flanges 172, 174 for mounting the transmission 160 to the plate 170 and the bracket 168 to the platform 90, respectively. With this arrangement, the output shaft 163 of the transmission 160 extends downwardly and rearwardly through the opening 39 in the wall 37 of the hull at the same slope as the plate 170.

A bearing sleeve 180 has a head 182 that receives an O-ring (not shown) and rests against an inner surface of the wall 37 and a threaded shaft 184 that extends through the opening 39. An O-ring 186 and threaded nut 188 are received onto the bearing sleeve 180 and press against the outer surface of the wall 37 to form a water-tight seal. Preferably, the bearing sleeve is constructed of a waterproof or water-resistant material that also exhibits a low coefficient of friction, such as nylon, brass, or the like. The output shaft 163 extends through the bearing sleeve 180 and rotates freely with respect thereto. The output shaft 163 also preferably forms a waterproof seal with the bearing sleeve 180 through one or more additional O-rings (not shown) mounted between the output shaft and bearing sleeve, or through any other well known shaft sealing means. With this construction, the transmission 160 is secured to the hull 12 at two separate locations, i.e. on the base frame 80 and the wall 37 to thereby reduce torsional and/or other forces that may be acting on the transmission during use.

Figure 7:
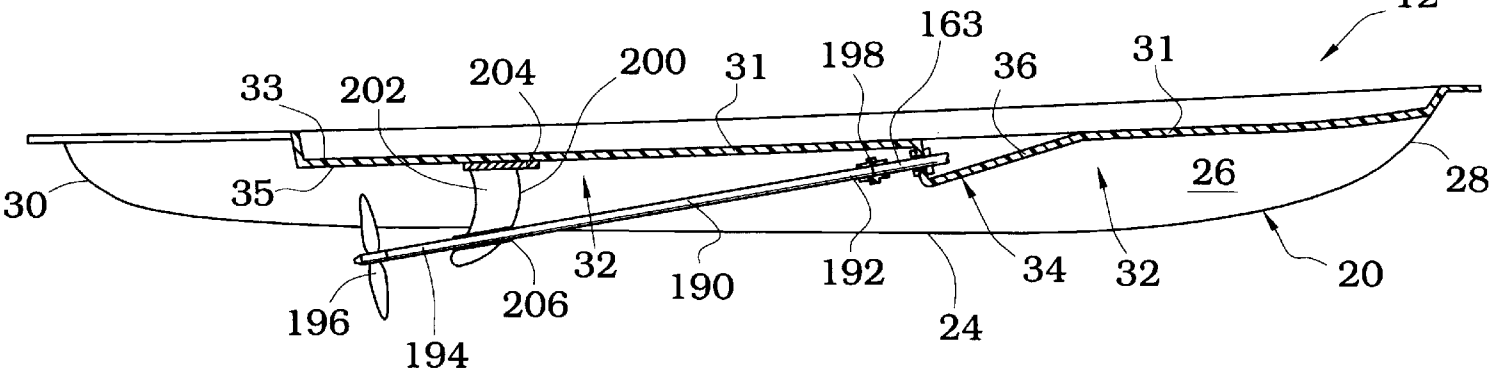
FIG. 7 is a longitudinal cross sectional view of the hull with an installed drive shaft and propeller.

With additional reference to FIG. 7, a drive shaft 190 has a first end 192 that is coupled to the output shaft 163 for rotation therewith and a second end 194 that has a propeller 196 mounted thereto. Preferably, the outer end of the output shaft 163 and the first end 192 of the drive shaft 190 are received in an elastomeric bushing 198 that frictionally couples the shafts together such that rotation of the output shaft causes rotation of the drive shaft. The elastomeric bushing also serves to correct for minor misalignment between the output shaft and the drive shaft and to at least partially isolate the transmission when the propeller becomes stuck due to entanglement with underwater weeds or the like to thereby prevent damage to the propeller when a user continues to operate the pedal assembly. Alternatively, a rigid sleeve with appropriate fasteners or other connection means may be provided for coupling the output shaft to the drive shaft. The drive shaft 190 preferably extends downwardly and rearwardly from the bushing with the same slope as the output shaft 163. Accordingly, the rotational axis of the drive shaft 190 is coincident with the rotational axis of the output shaft 163.

A skeg 200 for supporting the drive shaft 190 includes a blade-like member 202 extending downwardly from a curved flange 204. The flange 204 is mounted to the lower surface 35 of the upper wall 31 through adhesive, fasteners, or the like. When fasteners are used, it is preferable that a plate (not shown) be located on the upper surface 33 to sandwich the upper wall between the flange 204 and the plate. A bearing sleeve 206 constructed of nylon, brass, or the like intersects the blade-like member 202 and rotatably receives the drive shaft 190.

Referring again to FIGS. 3, 4 and 5, the adjustable seat assembly 88 includes a pair of rails 208 fixedly mounted to the platform 90 adjacent the legs 92 and 94. A seat 210 is pivotally mounted on a sliding adjustment plate 216 which is in turn mounted for selective sliding movement on the pair of rails 208. The seat 210 includes a lower body support 212 and a back support 214. Preferably, the seat 210 is constructed as a single, unitary structure. A pair of lower mounting tabs 218 (only one shown in FIG. 3) extend downwardly from a forward portion of the lower body support 212. Each mounting tab has an aperture that aligns with an aperture in the sliding plate 216. A fastener (not shown) extends through each set of aligned apertures for pivotally mounting the forward end of the seat 210 to the adjustment plate. A pair of upper mounting tabs 224 (only one shown in FIG. 3) extend rearwardly from the back support 214. A pair of adjustable support arms 220 extend between the back support 214 and the sliding plate 216. Each support arm 220 includes an upper arm portion 222 that is pivotally connected to one of the upper mounting tabs 224, and a lower arm portion 226 that telescopically receives the upper arm portion 226. The lower arm portion 226 is in turn pivotally connected to the sliding plate 216. A plurality of apertures 228 are formed in the upper arm portion and a knob 230 extends through the lower arm portion for selectively engaging one of the apertures. Preferably, the knob threadably engages the apertures, but may be biased toward the apertures in a well-known manner. With this arrangement, the tilt of the seat 210 can be adjusted by disengaging the knob 230 from one of the apertures 228, rotating the seat forwardly or rearwardly until the desired amount of tilt is obtained, and engaging the knob 230 with another of the apertures 228.

A pair of extension bars 232 are mounted to, and extend forwardly from the sliding plate 216. A spring-loaded locking knob 234 is mounted on each extension bar and is adapted to engage one of the apertures 236 formed in the rail 208. Adjustment of the distance between the seat 210 and the pedal assembly 82 is accomplished by pulling upwardly on the knobs 234 to disengage the knobs from their respective apertures, sliding the seat either forwardly or rearwardly until the desired distance is achieved, then seating each knob in another of the apertures.

Figure 3C:
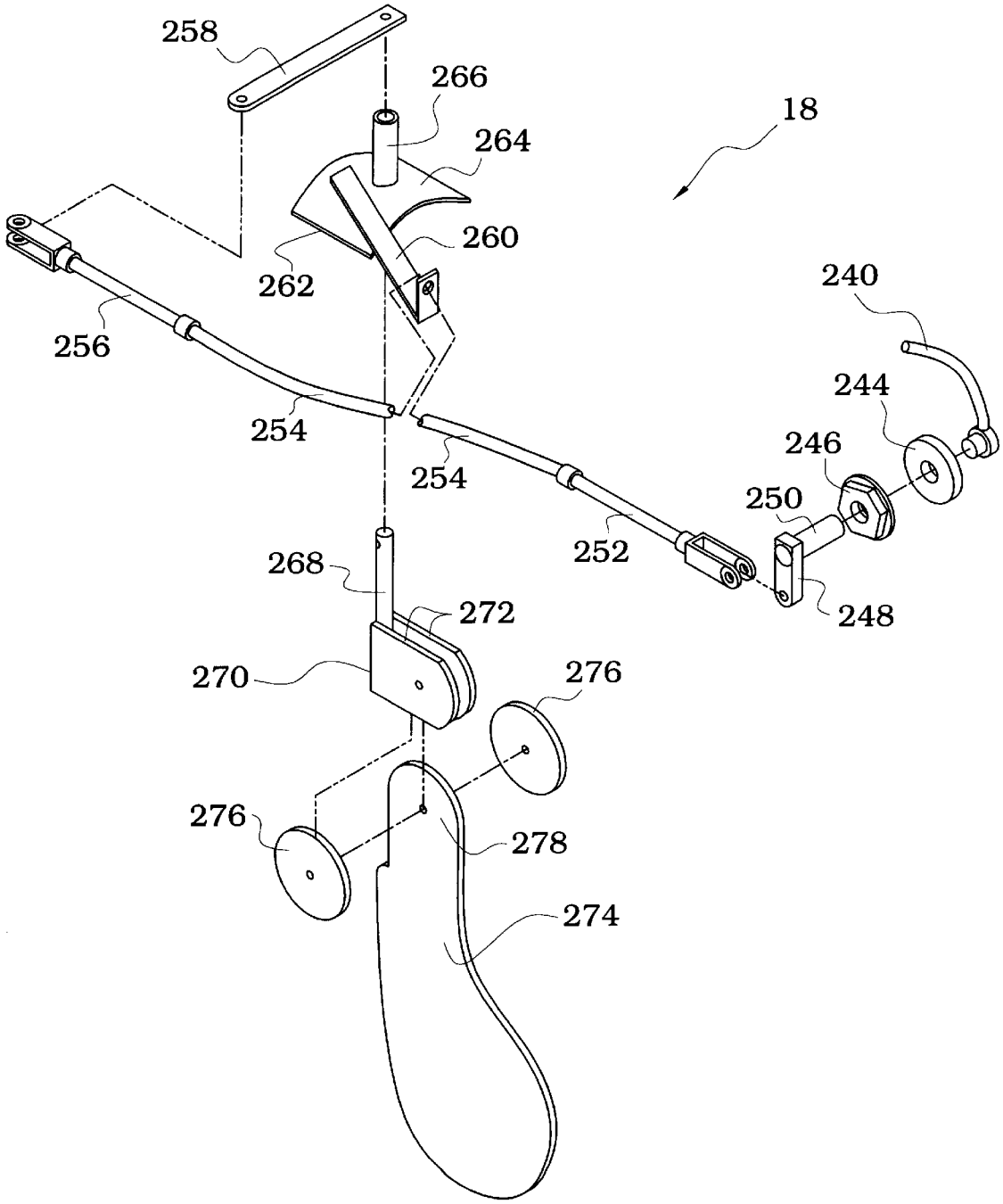
FIG. 3C is an enlarged exploded isometric view of the steering assembly of FIG. 3.

As shown best in FIG. 3C, the steering assembly 18 comprises a steering control arm 240 rotatably connected to an inner wall 242 (FIG. 3) of the cowling 66. The steering arm 240 is fixedly connected to a shaft 250 of a lever arm 248. A washer 244 and a nut 246 are positioned on the shaft 250 and sandwich the wall 242 therebetween. The lever arm 248 is pivotally connected to a front linkage 252 of a sheathed cable 254. A rear linkage 256 of the sheathed cable 254 is in turn pivotally connected to a tiller 258 with the sheathed portion of the cable being fixedly connected to an arm 260 of a rudder mounting bracket 262. The rudder mounting bracket has a curved base 264 that mounts to the upper surface 33 of the tunnel 32 through adhesive, fasteners or the like, and a sleeve 266 extends upwardly from the base 264. The sleeve 266 rotatably receives a shaft 268 of a rudder pivot bracket 270. A pair of spaced arms 272 form part of the rudder pivot bracket 270 and are mounted on opposite sides of the shaft 268. A rudder 274 has an upper end 278 that is sandwiched between a pair of nylon washers 276 or the like. The rudder upper end 278 together with the washers 276 are received within the spaced arms. Preferably, the rudder is pivotally connected to the arms 272 so as to rotate upwardly when encountering foreign objects during use. In this manner, the rudder 274, the rudder mounting bracket 262, the rudder pivot bracket 270, as well as the hull 12 are less prone to damage. The rudder 274 and pivot bracket 270 are shown extending in a forward direction in FIG. 3 for clarity. In actual use, the rudder and post would extend in the opposite direction.

In use, upon entering the watercraft 10, a user may find it necessary to adjust the seat inclination and position as well as the location of the pedals by tilting the pedal tower to a comfortable position, as previously described. As the user reclines in the seat and uses the pedals 130 to rotate the upper sprocket wheel 126, the chain 166 forces rotation of the lower sprocket wheel 164, which in turn causes the propeller 196 to rotate through the transmission 160 at a higher rotational velocity than the lower sprocket wheel to thereby propel the watercraft 10 through the water. The tunnel 32 forms a half-vortex which channels water toward the propeller during forward movement of the watercraft while at least partially blocking side currents that may be present. The tunnel hull helps to stabilize the watercraft during use and reduce the amount of surface area in contact with the water over conventional hulls and thus the amount of drag. Consequently, the watercraft can be operated at increased speeds with less pedal effort. In addition, the angle of the propeller 196 with respect to the hull 12 causes the watercraft 10 to lift slightly out of the water, which further reduces the surface area in contact with the water and its associated drag. The angle of the propeller can vary in the range of about 0 to about 45 degrees with respect to horizontal, and preferably is angled at about 8 degrees with respect to horizontal. Thus, the angle of the propeller 96 together with the tunnel 32 of the hull 12 create a pedal effort to watercraft speed efficiency that greatly exceeds the prior art. During trials of the above-described invention, it was found that a cruising speed of about 7 mph could be achieved and maintained with minimal effort from a person of average size and strength. Speeds of greater than 10 mph have been achieved with greater effort.

Although not shown, more than one lower sprocket wheel and/or upper sprocket wheel can be provided along with a derailleur or other gear adjusting mechanism for changing the gear ratio between the upper and lower sprocket wheels, and thus the rate of rotation between the upper wheel and the propeller.

Figure 8:
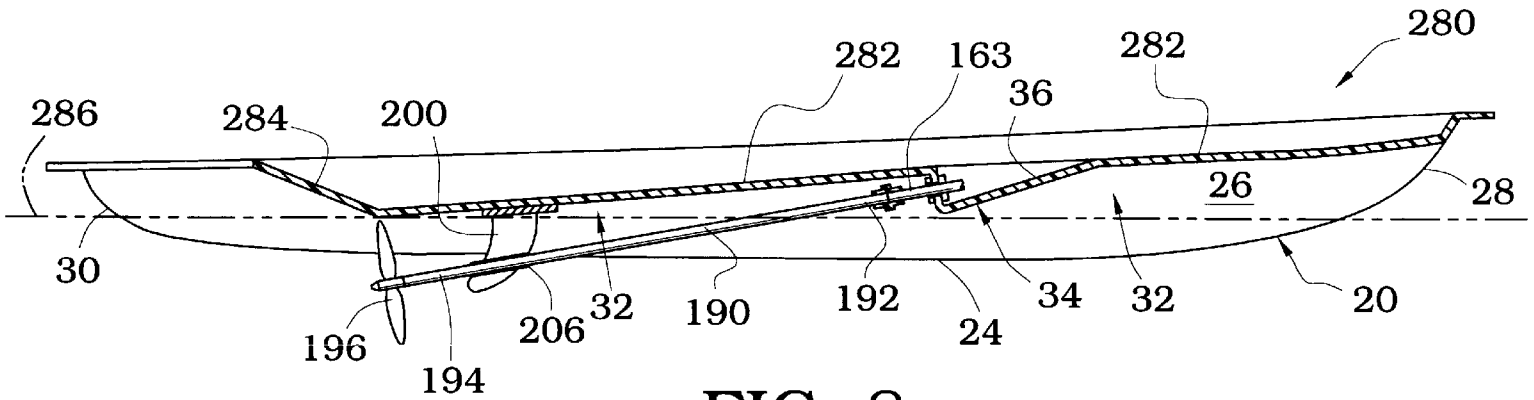
FIG. 8 is a longitudinal cross sectional view of the hull according to a further embodiment of the invention with an installed drive shaft and propeller.

With reference now to FIG. 8, a longitudinal cross section of a hull 280 according to a further embodiment of the invention is illustrated, wherein like parts in the previous embodiment are represented by like numerals. The hull 280 is similar in construction to the hull 12 previously described, with the exception that an upper wall section 282 of the tunnel 32 slopes generally downwardly and rearwardly from the bow to a plane defined by propeller rotation, and an upper wall section 284 that slopes generally upwardly from the wall section 282 toward the stern. With this construction, the possibility of air pockets in the propeller area is substantially reduced or eliminated since the entire propeller 196 is kept below the waterline 286 during use, even when the watercraft is subject to unequal loading between the bow and stern. Consequently, the watercraft is able to travel more efficiently in the water.

Figure 9:
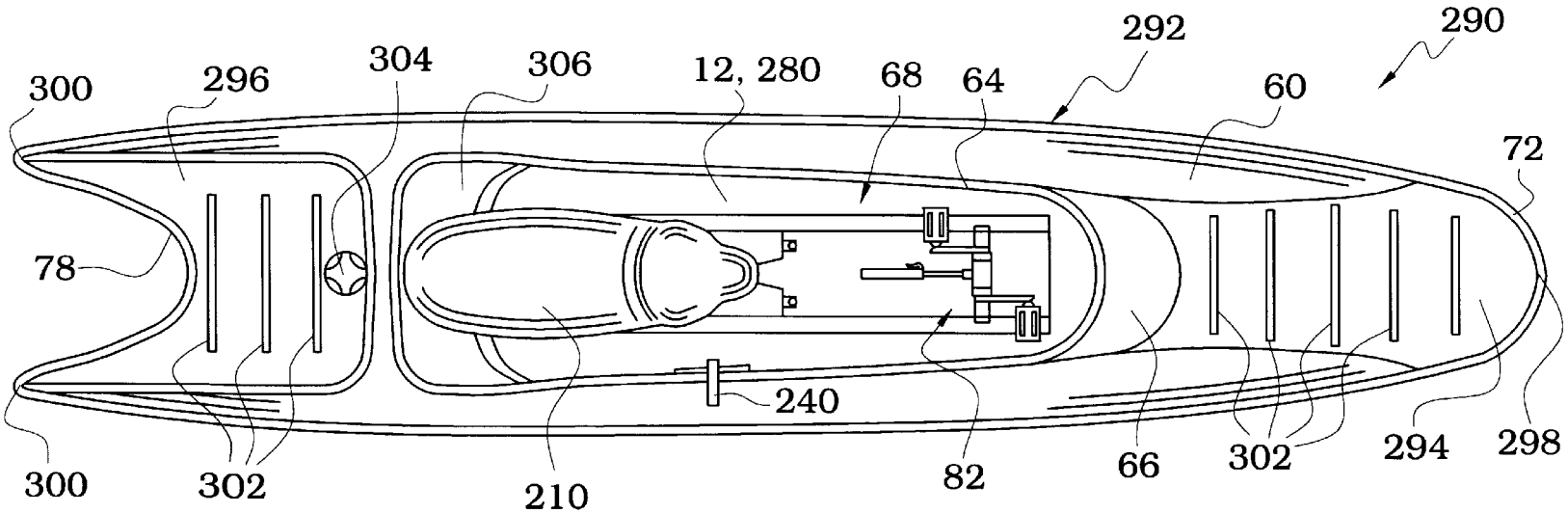
FIG. 9 is a top plan view of a pedal-powered watercraft according to a further embodiment of the invention.

Turning now to FIG. 9, a top plan view of a watercraft 290 according to a further embodiment of the invention is illustrated, wherein like parts in the previous embodiments are represented by like numerals. The watercraft 290 includes a deck 292 with relatively flat upper wall sections 294 and 296 formed at the bow and stern, respectively, of the watercraft. The upper wall section 294 preferably extends between the bow end 298 of the deck 292 and the front of the cowling 66 that surrounds the cockpit 68. Likewise, the upper wall section 296 preferably extends between the stern end 300 of the deck and the rear of the cowling 66, and encompasses the curved section 78. The upper wall section 296 together with the curved section 78 makes it easier for a person to climb into the watercraft from the water. A plurality of ribs 302 are preferably integrally formed on the upper wall sections 294, 296 for increased strength and rigidity. As shown, the ribs extend between the port and starboard sides of the deck 292 and may be of varying length. Although the ribs are preferably integrally formed, it is to be understood that the ribs may be formed separately and mounted to the upper wall sections. Hardware (not shown) may be connected to one or both of the upper wall sections for securing gear or the like thereto.

A deck plate 304 is removably attached to the upper wall section 296 and covers a tube (not shown) that extends through the deck 292 and hull 280 (or hull 12) directly above the propeller 196. When the cap 304 is removed, a user's hand and arm can be extended through the tube for removing underwater plants or other foreign matter from the propeller 196 in the event that the propeller becomes entangled. In this manner, it is unnecessary for the user to leave the watercraft to access the propeller.

A seat 306 is preferably integrally formed with the deck 292 behind the seat 210 to accommodate a passenger, equipment, or the like. Preferably, the opening 64 in the deck 292 gradually increases in width from the bow to the stern.

Figure 10:
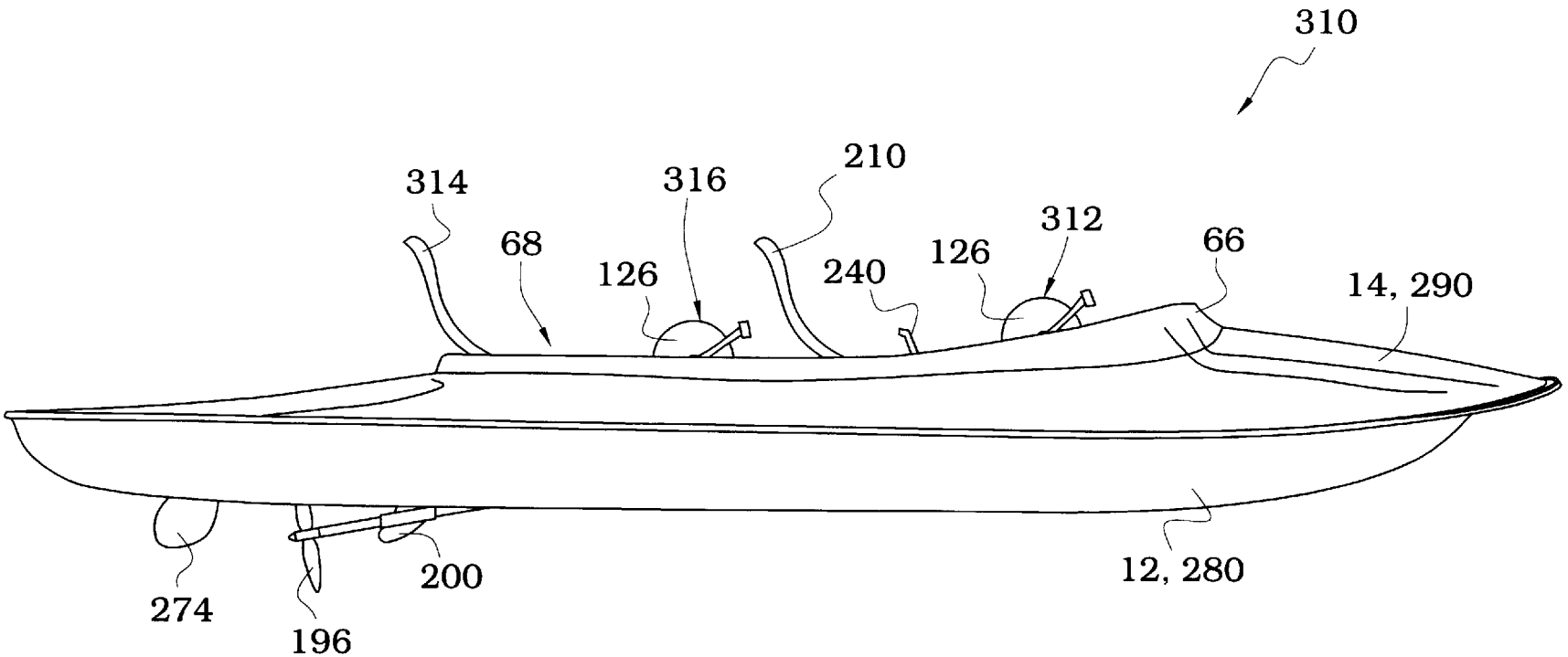
FIG. 10 is a side elevational view of a tandem pedal-powered watercraft according to an even further embodiment of the invention.
Figure 11:
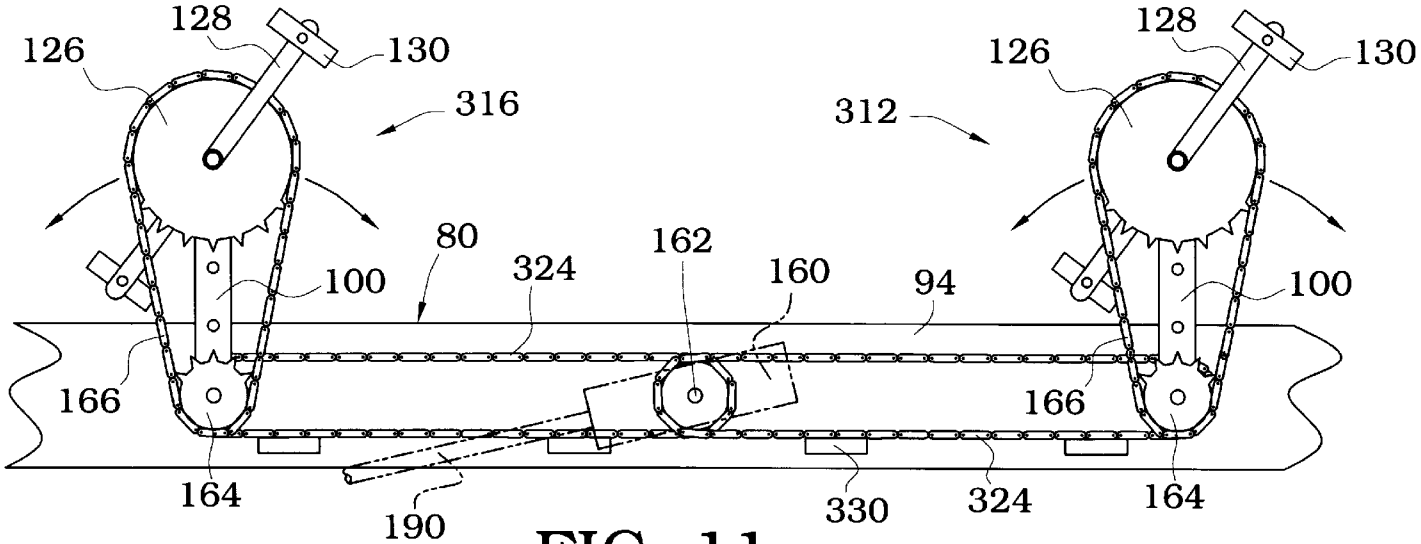
FIG. 11 is a side elevational view of a transmission and tandem pedal assemblies.
Figure 12:
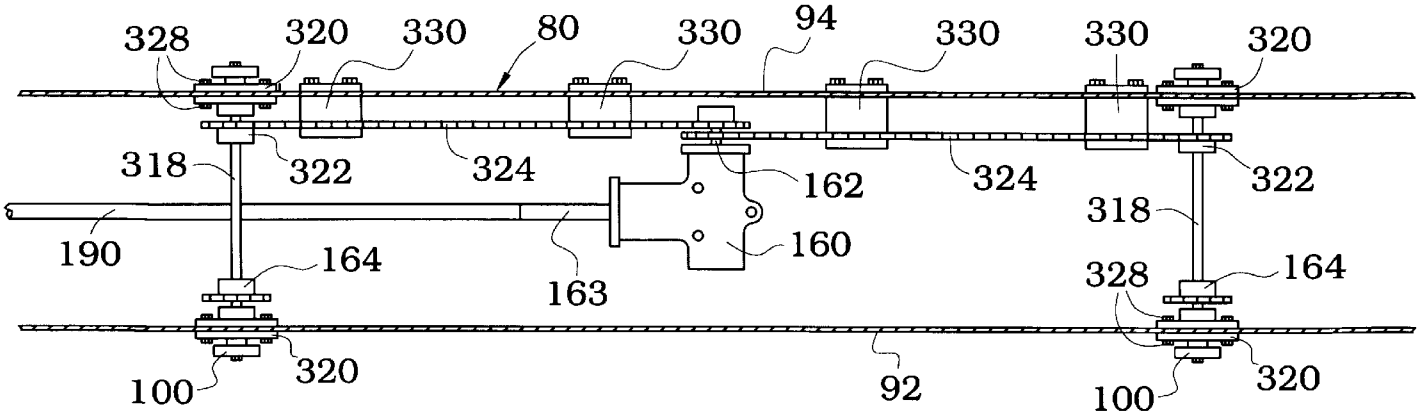
FIG. 12 is a top plan view of the transmission and tandem pedal assemblies of FIG.

With reference now to FIGS. 10 to 12, a watercraft 310 according to a further embodiment of the invention is illustrated, wherein like parts in the previous embodiments are represented by like numerals. The watercraft 310 includes a front reclining seat 210 with a front pedal assembly 312, and a rear reclining seat 314 with a rear pedal assembly 316. Preferably, the front and rear reclining seats 210, 314 are similar in construction to the seat 210 previously described.

Each pedal assembly 312, 316 includes an upper sprocket wheel 126 rotatably connected to an upper end of a pedal tower 100, a lower sprocket wheel 164 rotatably connected to the base frame 80, and an endless drive chain 166 that extends around the upper and lower sprocket wheels. An axle 318 extends between, and is rotatably mounted to a pair of flanged bearing blocks 320 located on the legs 92 and 94 of the base frame 80. The axle 318 is preferably constructed of a stainless steel material and is keyed or otherwise connected to the lower sprocket wheel 164 for rotation therewith. A freewheel sprocket 322 is connected to the axle 318 for rotation therewith only when the axle is rotated by the lower sprocket wheel 164, and is disconnected from the axle when the lower sprocket wheel 164 is idle. An endless drive chain 324 extends between each freewheel sprocket 322 and a double sprocket wheel 326 keyed or otherwise connected to the input shaft 162 of the transmission 160. Each of the flanged bearing blocks 320 includes fasteners 328 that can be loosened in order to move the bearing block along its associated leg 92, 94 for adjusting the tension of the drive chains 324. Guide blocks 330, constructed of nylon or the like, are mounted to the leg 94 for keeping the drive chains 324 in alignment with their associated sprocket wheels.

With the above-described tandem pedal assembly arrangement, either or both of the front and rear pedal assemblies can be operated to transfer rotational motion from the upper sprocket wheel(s) to the transmission 160 and drive shaft 190 independent of the other pedal assembly. When only one person is operating either the front or rear pedal assembly, the freewheel sprocket of the other pedal assembly will rotate without rotating the axle 318 to which it is mounted. In this manner, the pedals that aren't in operation remain stationary.

Figure 13:
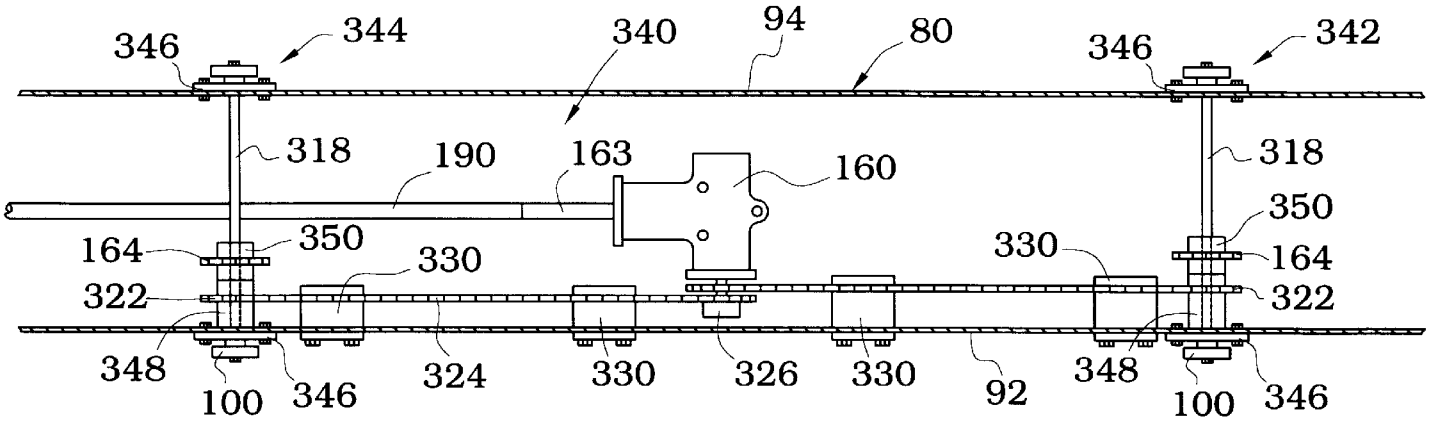
FIG. 13 is a top plan view of a transmission and tandem pedal assemblies according to a further embodiment of the invention.

Turning now to FIG. 13, a top plan view of a tandem pedal assembly 340 according to a further embodiment of the invention is illustrated, wherein like parts in the previous embodiment are represented by like numerals. The tandem pedal assembly 340 includes front and rear pedal assemblies 342, 344 that are similar in construction to the front and rear pedal assemblies of the previous embodiment, with the exception that the axle 318 is fixedly mounted to the legs 92, 94 of the base frame 80, and the lower sprocket wheel 164 and freewheel sprocket 322 are bolted or otherwise mounted together for mutual rotation around the axle 318. The axle 318 is preferably constructed of a solid ceramic material and is held stationary by a pair of axle mounting brackets 346 that are rigidly connected to opposite ends of the axle 318 and adjustably connected to the legs 92, 94 of the base frame 80. Preferably, both the freewheel sprocket 322 and the sprocket wheel 164 turn on a tubular Teflon™ bearing (not shown) held in place on the axle 318 between a spacer 348 and a shaft collar 350. With this arrangement, the four bearing blocks of the previous embodiment are eliminated, resulting in cost savings while maintaining the independent operability of each pedal assembly.

Figure 14:
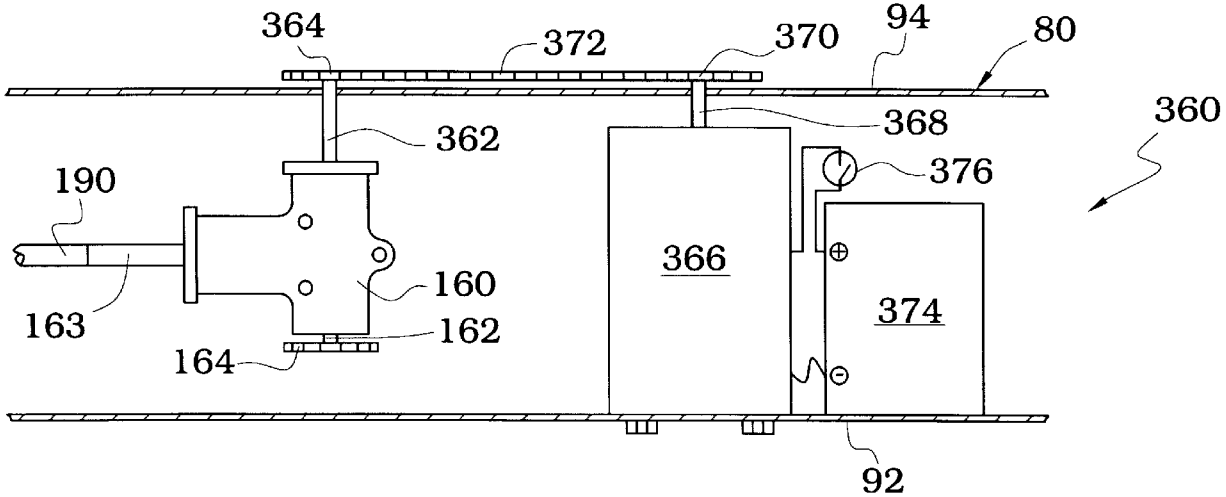
FIG. 14 is a top plan view of a power-assist assembly for use with any of the previous embodiments.

With reference now to FIG. 14, a top plan view of a motor assist unit 360 for use in conjunction with one or more of the previously described pedal assemblies is illustrated, wherein like parts in the previous embodiments are represented by like numerals. The motor assist unit 360 includes a transmission 160 having a first input shaft 162 connected to a first lower sprocket wheel 164 and a second input shaft 362 connected to a second lower sprocket freewheel 364. An electric motor 366 is connected to the base frame 80. The motor 366 includes a shaft 368 and a sprocket wheel 370 fixedly connected to the shaft for rotation therewith. An endless drive chain 372 extends between the second sprocket wheel 364 and the motor sprocket wheel 370. A battery 374 is electrically connected to the motor. Preferably, switching means 376 in the form of a torque sensor, a contact switch, or the like, is connected between the battery 374 and the motor 366 for selective actuation of the motor during operation of the watercraft. When a torque sensor is used, the motor 366 will be automatically actuated when the pedal force reaches a predetermined level to thereby assist or replace operator pedaling. When a contact switch is used, it is preferably manually manipulated by a user in order to actuate the motor at the user's discretion.

Figure 15:
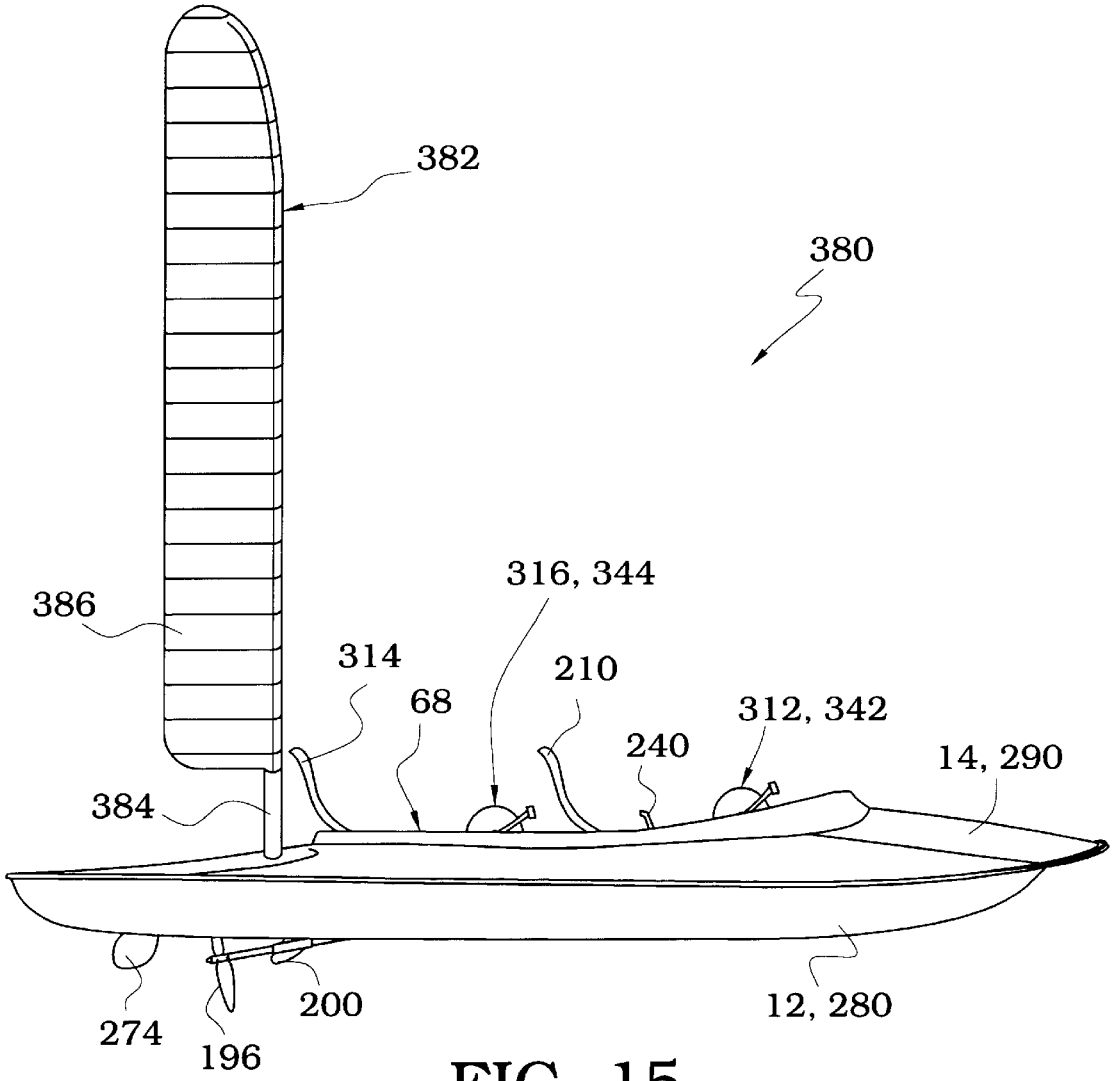
FIG. 15 is a side elevational view of a tandem pedal-powered watercraft similar to FIG. 10 with an installed wing sail.

Turning now to FIG. 15, a pedal-powered watercraft 380 is illustrated, wherein like parts in the previous embodiments are represented by like numerals. The watercraft 380 is similar in construction to the watercraft 310 previously described, with the addition of a wing sail 382 pivotally connected to the hull (12 or 280) and deck (14 or 290) rearwardly of the cockpit 68 and midway between the port and starboard sides of the hull. The wing sail 382 is relatively stiff in construction and includes a mast 384 and a blade-like sail portion 386 extending rearwardly of the mast. Rotation of the sail 382 about the mast 384 can be controlled by a steering assembly (not shown) similar to the steering assembly 18 for the rudder 274 previously described. Preferably, the sail is removable for facilitating storage and transportation.

Figure 16:
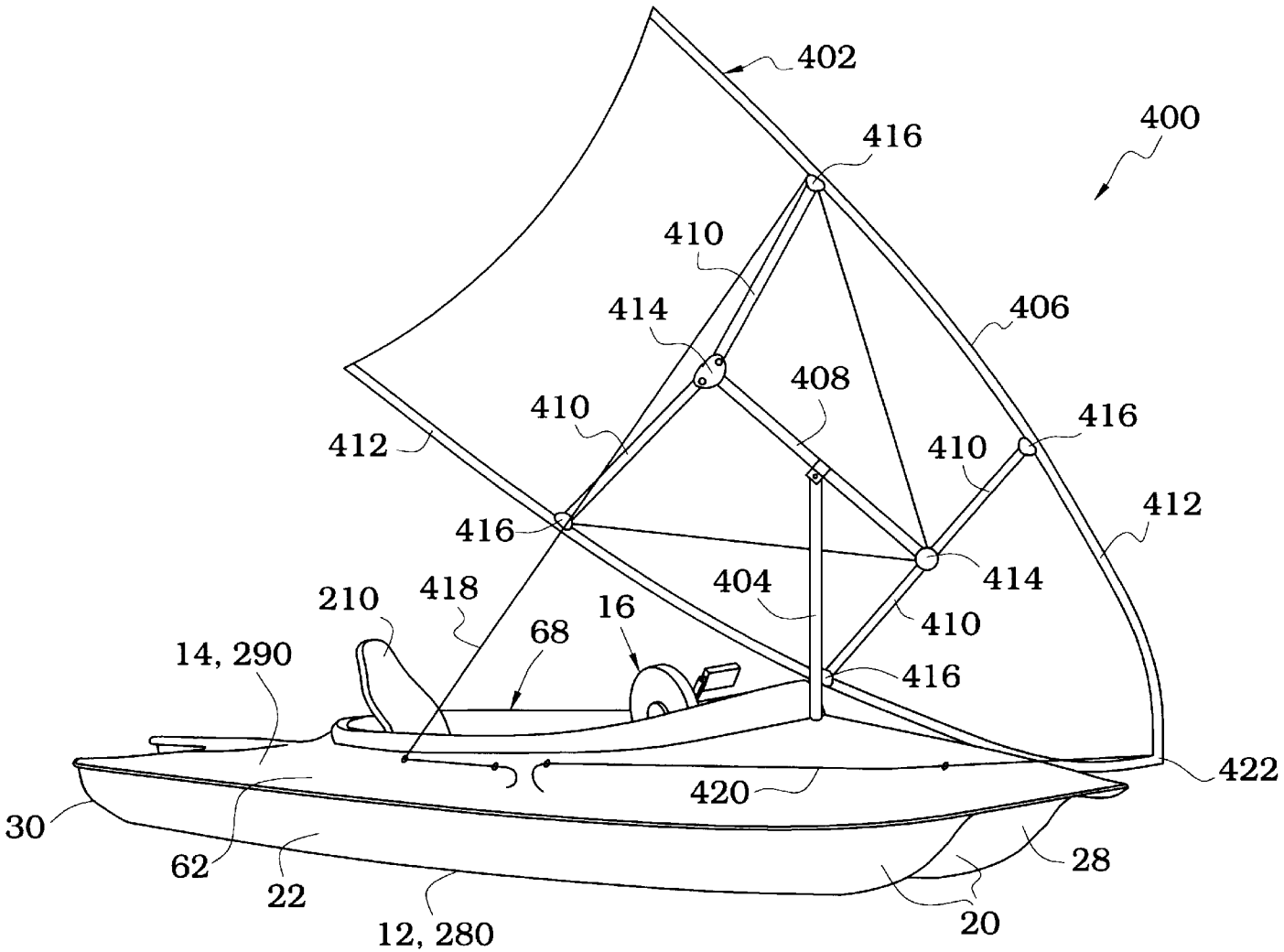
FIG. 16 is a perspective view of a pedal-powered watercraft similar to FIG. 1 with an installed law sail.

With reference now to FIG. 16, a pedal-powered watercraft 400 is illustrated, wherein like parts in the previous embodiments are represented by like numerals. The watercraft 400 is similar in construction to the watercraft 10 previously described, with the addition of a crab-claw sail 402 mounted forwardly of the cockpit 68 midway between the port and starboard sides of the hull (12 or 280) and deck (14 or 290). The crab-claw sail 402 includes a mast 404 that extends upwardly from the deck and a sail frame 406 pivotally connected to the mast. The frame 406 includes a longitudinally extending center support rod 408 that is pivotally connected to an upper end of the mast 404 and laterally extending support rods 410 that are pivotally connected at inner pivot joints 414 to the center support rod. The outer ends of the support rods 410 are in turn pivotally connected to outer support rods 412 at outer pivot joints 416. Preferably, the inner and outer pivot joints 414, 416 are releasably lockable so that the sail 402 can be folded during transportation and storage and locked into position during use. A rear cable 418 extends from an outer pivot joint 416 to the deck while a front cable 420 extends from a forward position 422 of the sail to the deck for controlling rotation of the sail around the mast 404. Preferably, the free ends of the cable are adjacent the cockpit 68 at a position convenient to a user. If desired, the cable ends can be terminated with a lever arm (not shown) or other mechanism for manipulating the sail. The crab-claw sail of the present invention provides both forward movement and lift to the watercraft. The lifting action of the sail lowers the waterline on the hull and therefore further reduces drag on the watercraft.

Figure 17:
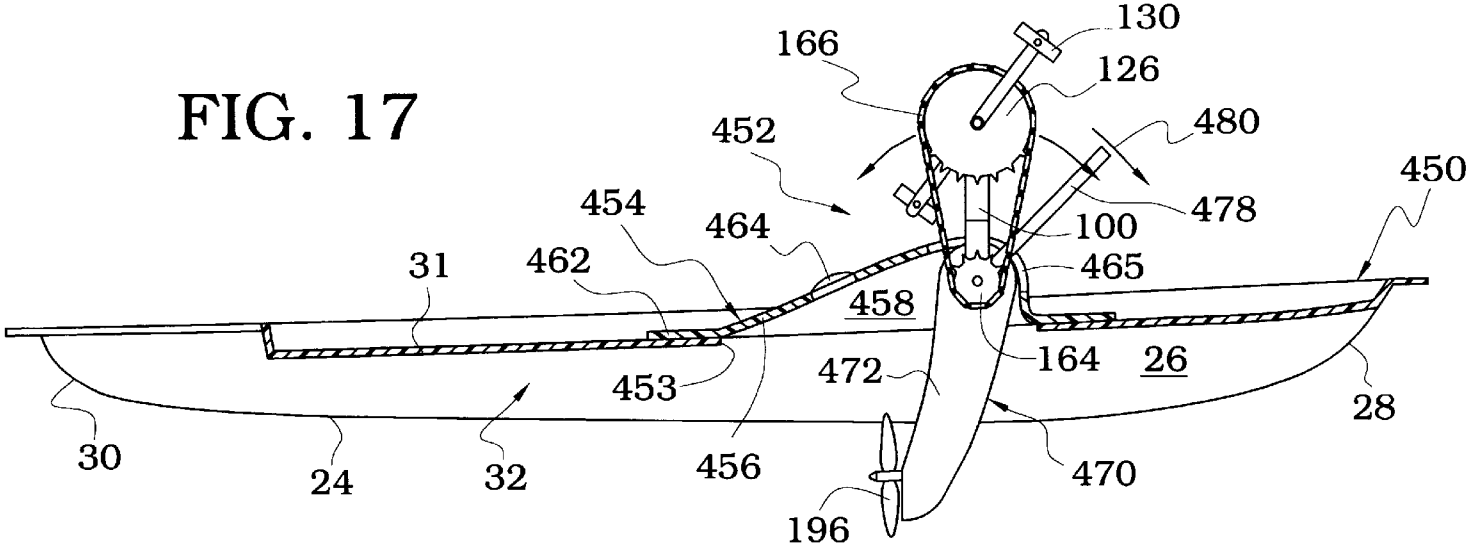
FIG. 17 is a longitudinal cross sectional view of a hull with an installed modular locomotion assembly according to a further embodiment of the invention.
Figure 18:
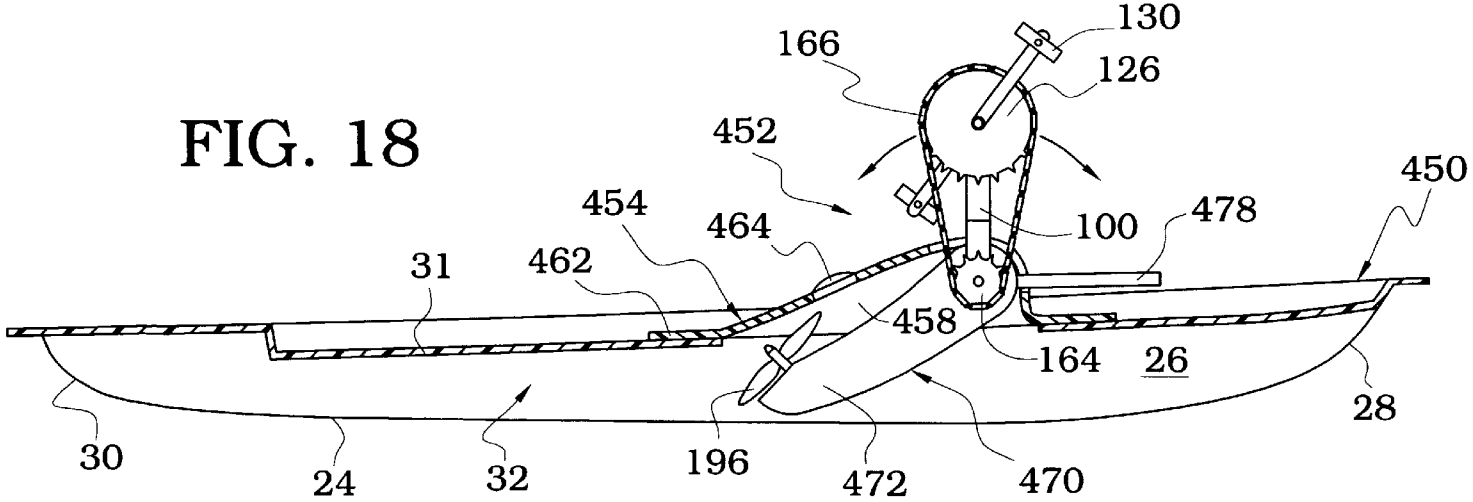
FIG. 18 is a view similar to FIG. 17 with the locomotion assembly in a retracted condition.
Figure 19:
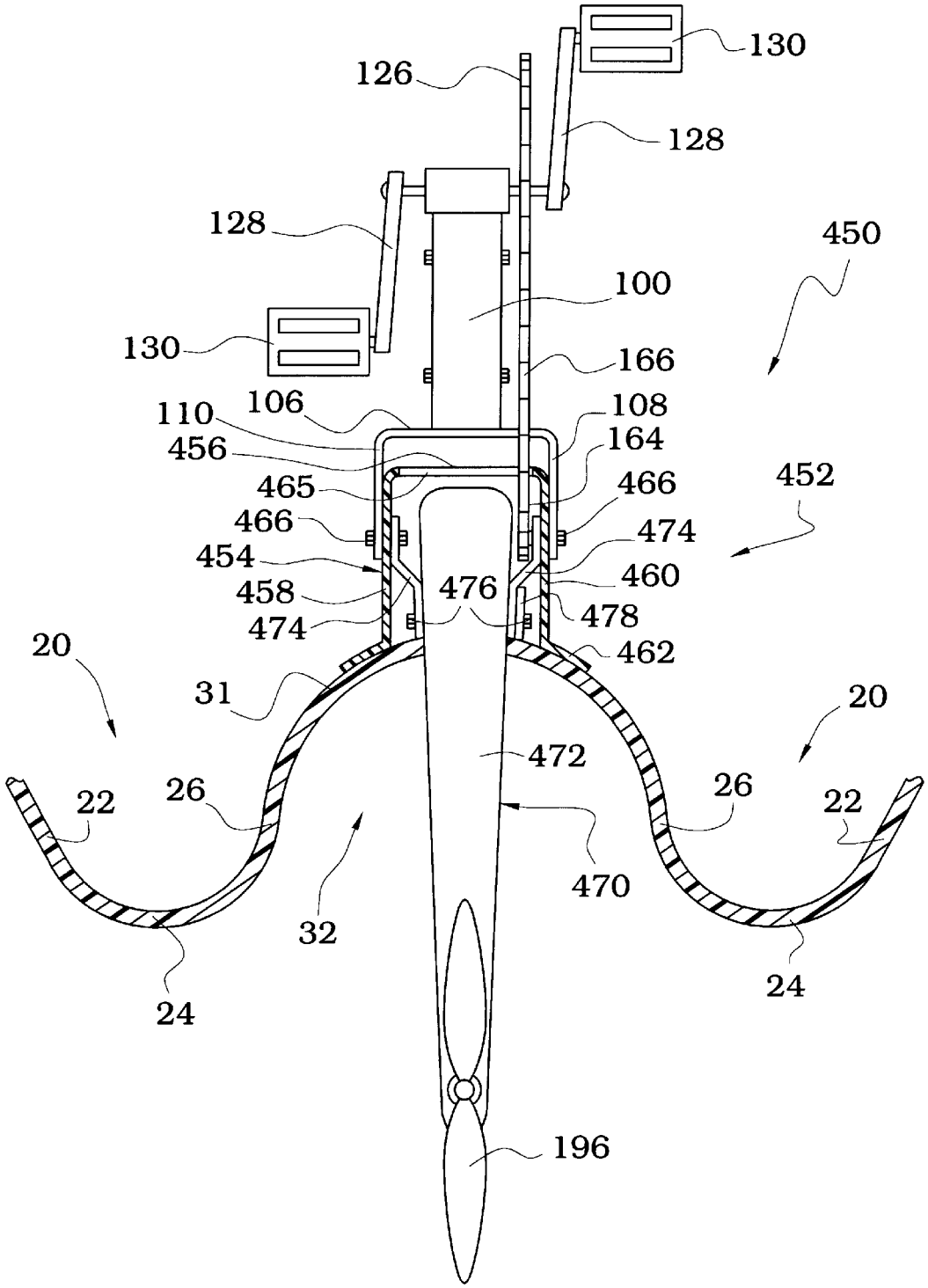
FIG. 19 is a rear elevational view of the modular assembly with a portion of the hull in cross section.

Turning now to FIGS. 17 to 19, a hull 450 with an installed locomotion assembly 452 according to a further embodiment of the invention is illustrated, wherein like parts in the previous embodiments are represented by like numerals. The hull 450 is similar in construction to the hull 12 as shown in FIG. 7, with the exception of a large opening 453 formed in the upper wall 31. A base frame 454 has an upper wall 456, a pair of sidewalls 458, 460 located on either side of the upper wall 456, and a peripheral mounting flange 462 that extends around a lower periphery of the side walls and upper wall. A rear portion of the upper wall 456 slopes generally upwardly and forwardly toward the bow from the peripheral mounting flange 462. Preferably, the base frame 454 is constructed of plastic material and is molded as a unitary structure. A deck plate 464 is removably mounted in an opening in the rear portion of the upper wall. The deck plate 464 is removable by a user in order to provide access to the propeller 196 for removing underwater plants or other foreign matter that may become entangled in the propeller and hinder or stop its rotation. In this manner, it is unnecessary for the user to exit the watercraft when the propeller is entangled in order to make the necessary corrections.

As best shown in FIG. 19, the pedal tower 100 is connected to the base frame 454 with the legs 108 and 110 of the inverse U-shaped bracket 106 straddling the upper wall 456 and the side walls 458, 460. A fastener 466 extends through each leg 108, 110 and their respective side walls 458, 460. As in the previous embodiments, the pedal tower 100 is preferably pivotally connected to the base frame 454 through the fasteners 466 and can be locked to any pivotal position in order to adjust the relative distance between the pedals 130 and a seat (not shown).

A modular propulsion unit 470 includes a housing 472 with an upper end that rotatably mounts the lower sprocket wheel 164 and a lower end that rotatably mounts the propeller 196. The lower sprocket wheel 164 is connected to drive the propeller 196 through any well-known coupling means (not shown) located within the housing 472 such as a drive shaft and cooperating bevel gears, a flexible drive cable, a drive belt or chain and pulley or sprocket wheel system, and so on. Details of an exemplary coupling means can be found in U.S. Pat. No. 4,459,116 issued to Moore on Jul. 10, 1984, the disclosure of which is hereby incorporated by reference.

A pair of pivot brackets 474 are fixedly mounted to opposite sides of the housing 472 through fasteners 476 and are pivotally connected to the side walls 458, 460 of the base frame 454 opposite the legs 110, 108. Preferably, the fasteners 466 that pivotally mount the tower 100 to the base frame also pivotally mount the brackets 474 such that the rotational axis of the pedal tower 100 is coincident with the rotational axis of the modular propulsion unit 470. In this manner, the pedal tower and propulsion unit can pivot independently of each other while maintaining the required distance between the lower sprocket wheel and upper sprocket wheel to keep the chain 166 taught, and while maintaining the distance between the lower sprocket wheel and the propeller 196.

A handle or lever arm 478 is fixedly connected to one of the pivot brackets 474 and extends outwardly through an opening 465 in the upper wall 456 of the base frame 454. Applying a force to the handle 478 in a direction as represented by arrow 480 in FIG. 17 causes the modular propulsion unit 470 to rotate from an extended in-use position to a retracted position in the tunnel 32, as shown in FIG. 18. This feature is especially convenient during transportation or when the watercraft is beached along a shore line. Although not shown, a bracket, cable, hook, ledge, or other means for holding or locking the modular propulsion unit 470 in the retracted and/or extended position can be provided.

Figure 20:
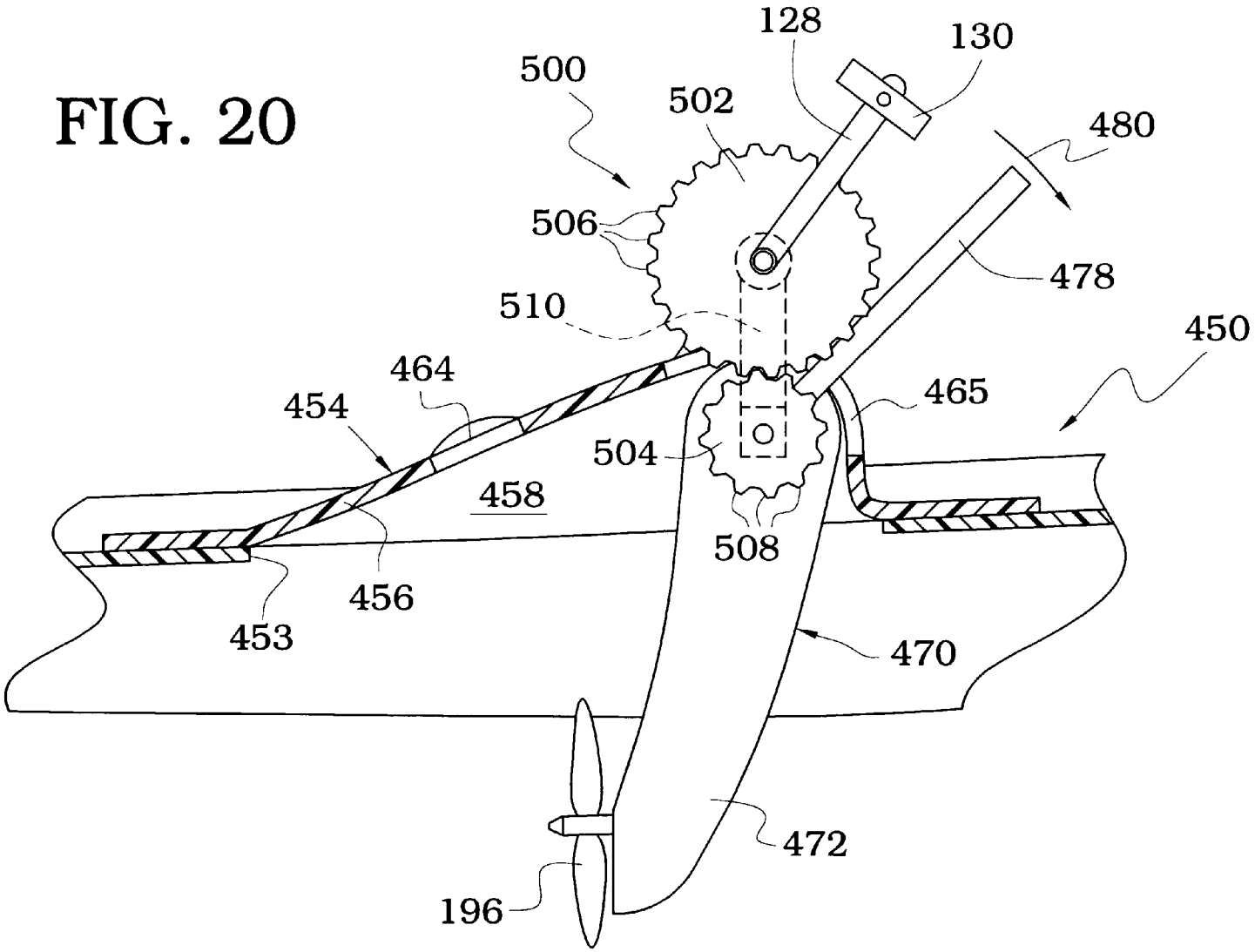
FIG. 20 is an enlarged cross sectional view of a hull with an installed modular locomotion assembly according to an even further embodiment of the invention.

With reference now to FIG. 20, a locomotion assembly 500 for use with the hull 450 according to a further embodiment of the invention is illustrated, wherein like parts in the previous embodiments are represented by like numerals. The locomotion assembly 500 is similar in construction to the locomotion assembly 452 previously described, with the exception that the upper sprocket wheel 126 is replaced with an upper gear 502 and the lower sprocket wheel 164 is replaced with a lower gear 504. The upper and lower gears are preferably constructed of a durable, water-resistant or waterproof material, such as nylon. The upper gear 502 has teeth 506 that mesh with teeth 508 of the lower gear 504 such that rotation of the pedals 130 causes rotation of the upper gear 502, which in turn causes rotation of the lower gear 504 to thereby drive the propeller 196. A pedal tower 510 (shown in hidden line) is similar in construction to the pedal tower 100 but preferably has a fixed length since it is no longer necessary to install or replace the drive chain or to adjust its tension. This arrangement is particularly advantageous over the previous sprocket wheel and chain embodiments, since there are fewer parts, no adjustments between the gears are needed, and are not subject to corrosion.

Although described in conjunction with the locomotion assembly 500, it is contemplated that the upper and lower gears can replace the upper and lower sprocket wheels and drive chain(s) of the previously described embodiments.

It is to be understood that the terms inner, outer, upper, lower, horizontal, vertical, and their respective derivatives, as used throughout the specification refer to relative, rather than absolute orientations and/or positions.

While the invention has been taught with specific reference to the above-described embodiments, those skilled in the art will recognize that changes can be made in form and detail without departing from the spirit and the scope of the invention. For example, in each of the above embodiments one or more of the foot pedals can be replaced with hand pedals for accommodating handicapped persons or for exercising the upper body.

Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or privilege is claimed are defined as follows:

1. An occupant-powered watercraft, comprising:

a unitary hull having an upper wall extending from a bow portion to a stern portion of the watercraft, and a pair of spaced hollow sponsons, each sponson extending along the length of the hull and having an inner wall connected to an outer wall by a bottom wall and front and rear walls to thereby form a hollow interior, the sponsons being located on opposite sides of the upper wall and being integrally joined therewith at the inner walls, the upper wall together with the inner walls of the sponsons forming a tunnel that opens generally downwardly and extends from the bow portion to the stern portion of the watercraft;

a deck connected to the hull, the deck having an elongate opening that defines a cockpit area for receiving an occupant;

a first seat located in the cockpit area;

a pedal assembly connected to the hull forwardly of the seat and including a pair of rotatable pedals; and a propeller operably connected to the pair of pedals for rotation in response to rotation of the pedals;

wherein forward movement of the watercraft from rotation of the propeller causes water to enter into the tunnel at the bow portion and exit the tunnel at the stern portion.

2. An occupant-powered watercraft according to claim 1, wherein a portion of the propeller is located outside of the tunnel and another portion of the propeller is located inside the tunnel during propeller rotation.

3. An occupant-powered watercraft according to claim 2, wherein the inner wall of each sponson together with the upper wall are shaped to form a semi-cylindrical tunnel.

4. An occupant-powered watercraft according to claim 3, wherein a rotational centerline of the propeller extends at an acute angle with respect to the upper wall to thereby cause the watercraft to lift at least partially out of the water during forward movement.

5. An occupant-powered watercraft according to claim 3, wherein the semi-cylindrical tunnel is substantially uniform in shape throughout its length.

6. An occupant-powered watercraft according to claim 1, wherein the upper wall has a forward portion that extends generally downwardly and rearwardly toward the propeller from the bow portion, such that water passing through the tunnel is channeled toward the propeller.

7. An occupant-powered watercraft according to claim 6, wherein a rotational centerline of the propeller extends at an acute angle with respect to the upper wall to thereby cause the watercraft to lift at least partially out of the water during forward movement.

8. An occupant-powered watercraft according to claim 6, wherein the upper wall has a rear portion that extends generally upwardly and rearwardly from the forward wall portion.

9. An occupant-powered watercraft according to claim 1, and further comprising a base frame mounted on the tunnel and extending upwardly therefrom, the pedal assembly being mounted to the base frame.

10. An occupant-powered watercraft according to claim 9, wherein the pedal assembly further comprises a pedal tower having a lower end connected to the base frame and an upper end that rotatably mounts the pair of pedals at a first rotational axis.

11. An occupant-powered watercraft according to claim 10, and further comprising a transmission connected to the base frame below the pedal tower, the transmission having an input shaft that is operably connected to the pair of pedals and rotatable about a second rotational axis, and an output shaft operably connected to the propeller.

12. An occupant-powered watercraft according to claim 11, wherein the pedal assembly further comprises an upper sprocket wheel connected to the pair of pedals for rotation therewith about the first rotational axis, and further comprising:

a lower sprocket wheel connected to the input shaft for rotation about the second rotational axis; and an endless drive chain extending between and engaging the upper and lower sprocket wheels;

wherein rotation of the pair of pedals causes rotation of the input shaft which in turn causes rotation of the output shaft to thereby drive the propeller.

13. An occupant-powered watercraft according to claim 12, and further comprising a drive shaft coupled between the output shaft and the propeller to thereby rotate the propeller during rotation of the output shaft.

14. An occupant-powered watercraft according to claim 13, wherein a rotational axis of the propeller extends at an acute angle with respect to the upper wall to thereby cause the watercraft to lift at least partially out of the water during forward movement.

15. An occupant-powered watercraft according to claim 12, wherein the lower end of the pedal tower is pivotally connected to the base frame about the second rotational axis such that the distance between the upper and lower sprocket wheels is maintained during pivotal movement of the pedal tower, and further comprising an adjustment member connected between the pedal tower and the base frame for selectively fixing the angle of the pedal tower with respect to the base frame to thereby adjust the distance between the pair of pedals and the seat.

16. An occupant-powered watercraft according to claim 15, wherein the transmission and propeller are pivotally connected to the base frame for pivotal movement about the second rotational axis, the pivotal movement of the transmission and propeller being independent of the pivotal movement of the pedal tower.

17. An occupant-powered watercraft according to claim 16, and further comprising a lever arm fixedly connected to the transmission for selectively pivoting the transmission and propeller between a retracted position and an extended in-use position.

18. An occupant-powered watercraft according to claim 15, wherein the seat is slidably mounted on the base frame for movement toward and away form the pedal assembly.

19. An occupant-powered watercraft according to claim 15, wherein the seat is slidably mounted on the base frame for movement toward and away from the pedal assembly.

20. An occupant-powered watercraft according to claim 11, wherein the transmission and propeller are pivotally connected to the base frame for pivotal movement about the second pivot axis.

21. An occupant-powered watercraft according to claim 20, and further comprising a lever arm fixedly connected to the transmission for selectively pivoting the transmission and propeller between a retracted position and an extended in-use position.

22. An occupant-powered watercraft according to claim 11, wherein the transmission is fixedly connected to the base frame, and further comprising:

an opening in the hull proximal the transmission; and a bearing member fixedly connected to the opening with the output shaft extending through the bearing member.

23. An occupant-powered watercraft according to claim 11, wherein the transmission has a second input shaft that is rotatable about the second rotational axis and operably connected to the output shaft, and further comprising a motor operably connected to the second input shaft to thereby cause the output shaft to drive the propeller.

24. An occupant-powered watercraft according to claim 23, wherein the motor is an electric motor, and further comprising:

a battery connected to the motor; and a switch interposed between the battery and the motor for selective actuation of the motor.

25. An occupant-powered watercraft according to claim 24, wherein the switch is a torque sensor for actuating the motor when a torque on one of the input shafts is above a predetermined level.

26. An occupant-powered watercraft according to claim 9, and further comprising:

a second seat located behind the first seat;

a second pedal assembly connected to the base frame between the first and second seats, the second pedal assembly having a second pair of rotatable pedals;

a transmission connected to the base frame, the transmission having an input shaft that is rotatable about a first rotational axis and operably connected to each pedal assembly and, and an output shaft operably connected to the propeller.

27. An occupant-powered watercraft according to claim 26, and further comprising:

a pair of sprocket wheels mounted on the input shaft for rotation therewith;

each of the first-mentioned and second pedal assemblies further comprising:

a pedal tower having a lower end connected to the base frame and an upper end that rotatably mounts the pair of pedals;

an upper sprocket wheel connected to the pair of pedals;

a lower sprocket wheel rotatably connected to the base frame; and an endless drive chain extending between and engaging the upper and lower sprocket wheels of each pedal assembly;

a forward endless drive chain extending between and engaging the lower sprocket wheel of the first pedal assembly and one of the sprocket wheels of the input shaft; and a rear endless drive chain extending between and engaging the lower sprocket wheel of the second pedal assembly and the other of the sprocket wheels of the input shaft;

wherein rotation of the pairs of pedals causes rotation of the input shaft which in turn causes rotation of the output shaft to thereby drive the propeller.

28. An occupant-powered watercraft according to claim 27, wherein each of the lower sprockets is a free-wheel sprocket that rotates when driven by its associated pair of pedals to thereby drive the transmission, and that rotates independent of its associated pair of pedals when driven by the transmission, whereby the rotation of one pair of pedals by an occupant does not cause rotation of the other pair of pedals.

29. An occupant-powered watercraft according to claim 27, wherein the pedal tower of each of the first and second pedal assemblies has a lower end pivotally connected to the base frame such that the distance between the upper and lower sprocket wheels is maintained during pivotal movement of the pedal tower, and further comprising an adjustment member connected between the pedal tower and the base frame for selectively fixing the angle of the pedal tower with respect to the base frame to thereby adjust the distance between the pair of pedals and its associated seat.

30. An occupant-powered watercraft according to claim 29, wherein each seat is slidably mounted on the base frame for selective movement toward and away from its respective pedal assembly to thereby adjust the distance between each pair of pedals and its respective seat.

31. An occupant-powered watercraft according to claim 26, wherein the upper wall has a forward wall portion that extends generally downwardly and rearwardly toward the propeller from the bow portion, such that water passing through the tunnel is channeled toward the propeller.

32. An occupant-powered watercraft according to claim 31, wherein a rotational centerline of the propeller extends at an acute angle with respect to the upper wall to thereby cause the watercraft to lift at least partially out of the water during forward movement.

33. An occupant-powered watercraft according to claim 1, and further comprising a rudder pivotally mounted to the upper wall rearwardly of the propeller.

34. An occupant-powered watercraft according to claim 1, and further comprising a first pair of L-shaped inserts mounted to the hull on opposite sides of the tunnel at one of the bow and stern portions of the watercraft, the inserts each having an upper leg that extends generally laterally between the tunnel and the outer wall and longitudinally from the one portion toward the other portion, and a second leg that extends generally laterally between the tunnel and outer wall and downwardly from the first leg to the bottom wall to thereby form a first air chamber within each sponson.

35. An occupant-powered watercraft according to claim 34, and further comprising a second pair of L-shaped inserts mounted to the hull on opposite sides of the tunnel at the other of the bow and stern portions of the watercraft, the inserts of the second pair each having an upper leg that extends generally laterally between the tunnel and the outer wall and longitudinally from the other portion toward the one portion, and a second leg that extends generally laterally between the tunnel and outer wall and downwardly from the first leg to the bottom wall to thereby form a second air chamber within each sponson.

36. An occupant-powered watercraft according to claim 1, wherein the hull has an upper peripheral edge defined by the sponsons and the upper wall, and further wherein the deck has a lower peripheral edge connected to the upper peripheral edge of the hull.

37. An occupant-powered watercraft according to claim 36, wherein the lower peripheral edge of the deck is L-shaped, with a first leg that is connected to the upper peripheral edge and a second leg that extends generally downwardly from the first leg to thereby form a gripping surface for lifting and carrying the watercraft.

38. An occupant-powered watercraft according to claim 36, and further comprising a sail extending upwardly from the deck.

39. An occupant-powered watercraft according to claim 38, wherein the sail is mounted forwardly of the cockpit area.

40. An occupant-powered watercraft according to claim 38, wherein the sail is mounted rearwardly of the cockpit area.

41. An occupant-powered watercraft according to claim 1, and further comprising a second seat integrally molded with the deck at a rear portion of the cockpit.

* * * * *

UNITED STATES PATENT AND TRADEMARK OFFICE

CERTIFICATE OF CORRECTION

PATENT NO. : 6,210,242 B1
DATED : April 3, 2001
INVENTOR(S) : Harry Howard et al.

It is certified that error appears in the above-identified patent and that said Letters Patent is hereby corrected as shown below:

Column 3,
Line 7, after FIG., add -- 11. --.
Line 18, change "law" to -- crab claw --.

Signed and Sealed this

Nineteenth Day of March, 2002

*Attest:*

*Attesting Officer*

JAMES E. ROGAN
*Director of the United States Patent and Trademark Office*